US006097672A

United States Patent [19]

Kitahara et al.

[11] Patent Number: 6,097,672

[45] Date of Patent: Aug. 1, 2000

[54] DISPLAY DEVICE AND WATCH WITH SAME

[75] Inventors: Joji Kitahara, Shiojiri; Nobuhiro Koike, Chino, both of Japan

[73] Assignee: Seiko Epson Corporation, Tokyo, Japan

[21] Appl. No.: 09/142,902

[22] PCT Filed: Jan. 16, 1998

[86] PCT No.: PCT/JP98/00167

§ 371 Date: Apr. 2, 1999

§ 102(e) Date: Apr. 2, 1999

[87] PCT Pub. No.: WO98/32055

PCT Pub. Date: Jul. 23, 1998

[30] Foreign Application Priority Data

Jan. 17, 1997 [JP] Japan ..... 9-006887

[51] Int. Cl.[7] ..... G04B 19/20; G04B 19/24

[52] U.S. Cl. ..... 368/35; 368/37

[58] Field of Search ..... 365/35–38; 74/437, 74/457, 460, 461

[56] References Cited

U.S. PATENT DOCUMENTS 4,127,041 11/1978 Imazaike ..... 74/461

4,432,081 2/1984 Schwartz et al. ..... 365/35

FOREIGN PATENT DOCUMENTS 50-142265 11/1975 Japan .

52-134471 11/1977 Japan .

54-85765 7/1979 Japan .

*Primary Examiner*—Vit Miska

*Attorney, Agent, or Firm*—Stroock & Stroock & Lavan LLP

[57] ABSTRACT

A display device that prevents display jumping and corrects the display that includes a displaying transmission wheel which is meshed with a drive wheel and a displaying follower wheel is pressed by a spring toward the area between the drive wheel and the displaying follower wheel so as to elastically take up the play between the drive wheel and the displaying follower wheel. During feeding, the displaying follower wheel is positioned by the displaying transmission wheel. If a crown is pulled out and rotated, the displaying follower wheel is rapid-fed and corrects the display without the aid of the drive wheel and the displaying transmission wheel. At the same time, however, the displaying transmission wheel receives a force in the direction in which it is pressed out of a gap, whereby the engagement with the displaying follower wheel is released.

34 Claims, 16 Drawing Sheets

DISPLAY DEVICE AND WATCH WITH SAME

TECHNICAL FIELD

The present invention relates to a display device for use in the calendar display of a watch and the like. More specifically, the present invention relates to a feed mechanism of the display device.

BACKGROUND

In a calendar display device for displaying a date, a day and so forth in a wristwatch or the like, there are constructed a drive wheel to which a driving force is transmitted from a step motor or the like in a drive section, a follower wheel formed in a display section for effecting display with a date indicator, a day indicator and so forth, and a displaying transmission wheel for intermittently transmitting the rotation of the drive wheel to the follower wheel. For example, in a calendar display device shown in FIG. 17, a displaying transmission member 104 including two kinds of pawls 102, 103 is constructed with respect to a drive wheel 101 which rotates once in 24 hours, and once in 24 hours, one pawl 103 is meshed with an internal tooth 106 of a date indicator 105 (follower wheel) to rotate the date indicator 105 by one step. In addition, once in 24 hours, the other pawl 102 is meshed with an external tooth 108 of a day indicator 107 to rotate the day indicator 107 by one step. In addition, in the calendar display device, there are constructed a first display-correcting transmission wheel 113 by which a winding operation to a crown (not shown) is transmitted through a sliding pinion 112 of a winding stem 111, and a second display-correcting transmission wheel 114 which shifts to a position where it is internally meshed with the date indicator 105 when the winding stem 111 is pulled out by one step to rotate the crown in a correction direction for a date display. Therefore, it is possible to rapid-feed manually the date indicator 105 without the aid of the drive wheel 101 and the displaying transmission wheel 104. In addition, if the winding stem is pulled out by one step to rotate the crown in a correction direction for a day display (a direction opposite to the correction direction for the date display), the second display-correcting transmission wheel 114 is externally meshed with a third display-correcting transmission wheel 115 which is externally meshed with the day indicator 107, so that it is also possible to rapid-feed manually the day indicator 107.

In the thus constructed calendar display device, since the mesh between the pawls 102, 103 and the date indicator 105 and the day indicator 107 is released each time the displaying transmission wheel 104 finishes driving the date indicator 105 and the day indicator 107 by one step, if an external force is applied to a wristwatch, a phenomenon in which the date indicator 105 and the day indicator 107 freely rotate, a so-called display jumping, may occur. Thus, to the calendar display device, a mechanism for positioning the date indicator 105 and the day indicator 107 is imparted. For example, in the example shown in FIG. 17, a sheet-like jumper 121 is arranged with respect to the date indicator 105, and a top part 122 of the jumper 121 is engaged with the internal tooth 106 of the date indicator 105, as shown by the solid line L11, whereby the date indicator 105 is positioned and the display jumping of the date indicator 105 is prevented. Similarly, a sheet-like jumper 126 is provided with respect to the day indicator 107, and a top part 127 of the jumper 126 is engaged with the external tooth 108 of the day indicator 107, as shown by the solid line L12, whereby the day indicator 107 is positioned and the display jumping of the day indicator 107 is prevented.

Moreover, such a mechanism for preventing the display jumping of the date indicator and the day indicator, one making use of a lever and a cam, one making use of a Geneva mechanism, and one combining the Geneva mechanism and a jumper spring are disclosed in Japanese Unexamined Patent Publication Nos. 50-142265, 54-85756 and 52-134471, respectively.

However, in the conventional device making use of a jumper mechanism (see FIG. 17.), the top parts 122, 127 of the jumpers 121, 126 should rise above the internal tooth 106 of the date indicator 105 or the external tooth 108 of the day indicator 107 each time the date indicator 105 and the day indicator 107 are rotated by one step, as shown by the two-dot chain lines L13, L14 in FIG. 17, so that a force for deforming the jumpers 121, 126 is required. Therefore, there is a problem of a heavy load during the date feeding and the day feeding. Since such a load causes an increase in power consumption, the wristwatch requires an increase in size of a battery, thereby preventing a reduction in thickness of the wristwatch. In addition, when a power generation device making use of an oscillating weight or the like is contained in the wristwatch, the increased power required to deform jumpers 121, 126 requires a large-sized power generation device having high capability of power generation to accommodate the large power consumption, thereby preventing the reduction in thickness of the wristwatch.

On the other hand, in the device making use of a lever and a cam as disclosed in Japanese Unexamined Patent Publication No. 50-142265, it is difficult to properly set a timing of lifting the lever. In addition, in the device making use of the Geneva mechanism as disclosed in Japanese Unexamined Patent Publication No. 54-85765, the date feeding time is long, thus causing a slippage of date. Further, in the device disclosed in Japanese Unexamined Patent Publication No. 52-134471, there is a problem that jumping and slippage of date occur, and a heavy load for lifting a spring is required.

In consideration of the foregoing problems, an object of the present invention is to provide a display device in which the feeding operation load is light and display jumping does not occur, and a watch including the same.

In addition, an object of the present invention is to provide a display device which is also capable of correcting the display by rapid-feeding a displaying follower wheel, and a watch including the same.

SUMMARY OF THE INVENTION

In order to solve the above problems, the present invention provides a display device including a feed mechanism of a Geneva structure comprising a drive wheel constructed in a drive section, a displaying follower wheel constructed in a display section, and displaying transmission wheel engaging with both of the displaying follower wheel and the drive wheel to transmit an action of the drive wheel to the displaying follower wheel, wherein the feed mechanism has a lateral pressure-imparting means for imparting a lateral pressure in a direction to enter between the drive wheel and the displaying follower wheel to the displaying transmission wheel.

The feed mechanism of the display device to which the present invention is applied basically has the Geneva structure, and the lateral pressure-imparting means can fill up looseness of engagement portions between the displaying transmission wheel and the drive wheel, or looseness of engagement portions between the displaying transmission wheel and the displaying follower wheel by pressing the displaying transmission wheel. Moreover, a jumper spring is not employed. Accordingly, no excessive load is generated between the displaying transmission wheel and the drive wheel, and between the displaying transmission wheel and the displaying follower wheel. In addition, since the lateral pressure-imparting or biasing means presses the displaying transmission wheel toward the area between the displaying transmission wheel and the drive wheel, the displaying transmission wheel contacts the drive wheel or the displaying follower wheel during the interval of feed-driving, and positions the displaying follower wheel in this state. For this reason, when the displaying follower wheel is to be moved freely by disturbance or the like, the displaying transmission wheel acts as a load, so that display jumping can be prevented. Accordingly, according to the present invention, a display device in which a load of the feeding operation is light and display jumping does not occur can be realized.

In the present invention, the lateral pressure-imparting means takes up, for example, play between engagement portions in the displaying transmission wheel and the drive wheel and play between engagement portions in the displaying transmission wheel and the displaying follower wheel by imparting a lateral bias to the displaying transmission wheel.

In addition, the lateral biasing means may take up play between engagement portions in the displaying transmission wheel and the displaying follower wheel by imparting a lateral pressure in the direction inclined toward the displaying follower wheel between the drive wheel and the displaying follower wheel to the displaying transmission wheel. When constructed in this way, the displaying transmission wheel strongly positions the displaying follower wheel, so that display jumping of the displaying follower wheel can be more positively prevented. In addition, the drive wheel lightly contacts the displaying transmission wheel, so that there is an advantage in that a frictional load torque between the drive wheel and the displaying transmission wheel can be reduced during the interval of a calendar-feeding operation.

In constructing in this way, there may be a case where the lateral pressure-imparting means is constructed so as to impart the lateral pressure in the direction substantially parallel to the direction of the tangent to the contact position of the drive wheel and the displaying transmission wheel, in the contour circle of the drive wheel, to the displaying transmission wheel. That is, there may be a case where the lateral pressure-imparting means is constructed so as to impart a lateral pressure in a circumferential direction of the contour circle of the drive wheel at the intersection of the contour circle and a line connecting both center points of rotation of the drive wheel and the displaying transmission wheel to the displaying transmission wheel.

In addition, in the present invention, the lateral pressure-imparting means may fill up looseness between engagement portions of the displaying transmission wheel and the drive wheel by imparting a lateral pressure in the direction inclined toward the drive wheel between the drive wheel and the displaying follower wheel to the displaying transmission wheel. When constructed in this way, the displaying transmission wheel lightly contacts the displaying follower wheel, but strongly contacts the drive wheel, so that display jumping of the displaying follower wheel can be prevented. In addition, since the displaying transmission wheel lightly contacts the displaying follower wheel, the mesh between the displaying transmission wheel and the displaying follower wheel is slight when performing a normal feeding operation, so that there is an advantage in that a load due to stretch of teeth can be reduced.

In constructing in this way, the lateral pressure-imparting means may preferably be constructed so as to impart the lateral pressure in the direction substantially parallel to the direction of the tangent to the contact position of the driving follower wheel and the displaying transmission wheel, in the contour circle of the driving follower wheel, to the displaying transmission wheel. That is, the lateral pressure-imparting means may preferably be constructed so as to impart a lateral pressure in a circumferential direction of the contour circle of the displaying follower wheel at the intersection of the contour circle and a line connecting both center points of rotation of the displaying follower wheel and the displaying transmission wheel to the displaying transmission wheel. When constructed in this way, looseness is formed between engagement portions of the displaying transmission wheel and the displaying follower wheel, and the displaying transmission wheel does not advance between the drive wheel and the displaying follower wheel to become a wedge during the interval of the calendar-feeding operation. Therefore, only the load equivalent to the lateral pressure is applied to the drive wheel during the interval of the calendar-feeding operation. Thus, the drive wheel smoothly performs an operation of hands or the like. Moreover, since the displaying transmission wheel receives a circumferential lateral pressure with respect to the contour circle of the displaying follower wheel, the displaying transmission wheel is positively pressed against the drive wheel and the stopper, if the stopper is constructed. Therefore, the displaying transmission wheel is positively positioned by the stopper without being affected by variations in size of the displaying follower wheel, so that the position of the displaying follower wheel is determined precisely. Accordingly, the slippage of the calendar display is only by the amount corresponding to the looseness of the engagement portions between the displaying transmission wheel and the displaying follower wheel and hence, can be minimized.

In this embodiment, it is preferable that a stopper for preventing the displaying transmission wheel from advancing too far between the drive wheel and the displaying follower wheel is further included at the position on the side of the direction of the application of the lateral pressure with respect to the displaying transmission wheel. When constructed in this way, since the displaying transmission wheel does not mesh with the drive wheel or the displaying follower wheel by an excessive force, a meshing load when the drive wheel rotates the displaying transmission wheel, or a meshing load when the displaying transmission wheel rotates the displaying follower wheel is not increased.

In the present invention, the lateral pressure-imparting means may preferably abut against a rotating central shaft of the displaying transmission wheel at the position opposing the stopper so as to impart the lateral pressure heading toward the stopper to the displaying transmission wheel. When constructed in this way, even if the rotating central shaft of the displaying transmission wheel strikes the stopper, the rotating shaft does not tilt, so that the load of the drive wheel for rotating the displaying transmission wheel, or the load of the displaying transmission wheel for rotating the displaying follower wheel can be minimized.

In the present invention, it is preferable that a display-correcting feed mechanism which performs the correction of display by feed-driving the displaying follower wheel without the aid of the drive wheel and the displaying transmission wheel, through a separate driving force transmission path. In this case, the display-correcting feed mechanism, during the correction of display, can be constructed so as to feed-drive the displaying follower wheel in the same direction as the direction to feed-drive through the drive wheel and the displaying transmission wheel. In addition, the display-correcting feed mechanism, during the correction of display, may be constructed so as to feed-drive the displaying follower wheel in the direction opposite to the direction to feed-drive through the drive wheel and the displaying transmission wheel. In either case, since the displaying transmission wheel only positions the displaying follower wheel with elasticity, a force applied to the displaying transmission wheel when the displaying follower wheel is rapid-fed without the aid of the drive wheel and the displaying transmission wheel is absorbed by the elasticity, so that the displaying follower wheel can be rapid-fed smoothly.

In the present invention, it is preferable to achieve a reduction in thickness of the display device by arranging the drive wheel, the displaying transmission wheel and the displaying follower wheel on substantially the same plane. That is, it is preferable to achieve a reduction in thickness of the display device by arranging the drive wheel, the displaying transmission wheel and the displaying follower wheel so as not to overlap each other in plan view. In order to construct the device in this way, the displaying transmission wheel may comprise projections formed on its outer periphery to be engaged with recesses formed on the periphery of the displaying follower wheel, and recesses recessed from the tips of the projections to be engaged with a projection formed on the periphery of the drive wheel. When constructed in this way, common projections and recesses of the displaying transmission wheel are utilized for the mesh between the drive wheel and the displaying transmission wheel, and the mesh between the displaying follower wheel and the displaying transmission wheel, so that a reduction in thickness of the display device can be achieved by arranging the drive wheel, the displaying transmission wheel and the displaying follower wheel on the same plane.

In addition, the displaying transmission wheel may be constructed so as to comprise projections formed on its outer periphery to be engaged with recesses formed on the periphery of said displaying follower wheel, and with a recess formed on the periphery of said drive wheel. When constructed in this way, common projections of the displaying transmission wheel are also utilized for the mesh between the drive wheel and the displaying transmission wheel, and the mesh between the displaying follower wheel and the displaying transmission wheel, so that the reduction in thickness of the display device can be achieved by arranging the drive wheel, the displaying transmission wheel and the displaying follower wheel on the same plane. That is, the reduction in thickness of the display device can be achieved by arranging the drive wheel, the displaying transmission wheel and the displaying follower wheel so as not to overlap each other in plan view. In addition, on the periphery of the displaying transmission wheel, if the tips of the projections are split at recesses formed therein, the projection of the drive wheel should rise above one of the projections constituting the recesses of the displaying transmission wheel when the projection of the drive wheel enters the recesses of the displaying transmission wheel to be engaged therewith. For this reason, a load for lifting the displaying transmission wheel against a lateral pressure is applied to the projection of the drive wheel. However, if the displaying transmission wheel comprises simple projections which are not split at the tips thereof, such a load is not generated.

In the present invention, the displaying transmission wheel may comprise external teeth, while the displaying follower wheel may comprise internal teeth, and the displaying transmission wheel may be constructed so as to be internally engaged with said displaying follower wheel. In constructing the display transmission wheel in this way, there may be a case where the displaying follower wheel is formed in the shape of a ring having internal teeth, and is not connected to the rotating central shaft. In this case, the display section may preferably be provided with a guide mechanism for guiding the ring-shaped displaying follower wheel.

In the present invention, both of the displaying transmission wheel and the displaying follower wheel may comprise external teeth, and the displaying transmission wheel may be constructed so as to be externally engaged with the displaying follower wheel.

The external teeth or the internal teeth in the present invention are not limited to substances in which teeth are formed on the entire circumference with a predetermined pitch, such as normal gears, and stand for substances in which teeth are intermittently formed on one or two sections, and projections in shape such as intermittent cams. In either case, the substances may be preferable if they can transmit a driving force by being engaged and meshed with each other.

In the present invention, the lateral pressure-imparting means may be comprised of, for example, support means for supporting the displaying transmission wheel in a movable state in either a direction to enter between the drive wheel and the displaying follower wheel and an opposite direction thereof, and an elastic member for imparting a lateral pressure to the displaying transmission wheel through the rotating central shaft of the displaying transmission wheel. In this way, if the elastic member is constructed so as to abut against the rotating central shaft of the displaying transmission wheel, a frictional load torque between the rotating central shaft of the displaying transmission wheel and the elastic member can be reduced because the diameter of the rotating central shaft is small. In addition, there is an advantage in that the direction and the magnitude of the lateral pressure applied by the elastic member to the displaying transmission wheel can be easily controlled.

In addition, there may be a case where the lateral pressure-imparting means is comprised of support means for supporting the displaying transmission wheel in a movable state in either a direction to enter between the drive wheel and the displaying follower wheel and an opposite direction thereof, and an elastic member for imparting a lateral pressure to the displaying transmission wheel through the outer periphery of the displaying transmission wheel. When constructed in this way, the elastic member and the displaying transmission wheel can be arranged on the same plane, so that the reduction in thickness of the display device can be achieved. That is, the reduction in thickness of the display device can be achieved by arranging the elastic member and the displaying transmission wheel so as not to overlap each other in plan view.

In the present invention, the displaying transmission wheel may preferably be supported by the support means in a movable state in either direction toward the drive wheel and toward the displaying follower wheel. When constructed in this way, the displaying transmission wheel shifts to the most suitable position by the balance between the force received from the drive wheel and the force received from the displaying follower wheel. Therefore, the displaying transmission wheel can positively and properly fill up the clearances between the displaying transmission wheel and the drive wheel, and between the displaying transmission wheel and the displaying follower wheel, so that the rattle peculiar to the Geneva structure can be positively prevented.

In addition, the elastic member may preferably be constructed so that a spring constant is switched from a small value to a large value from midway of movement of the displaying transmission wheel in the direction opposite to the direction to enter between the drive wheel and the displaying follower wheel against a pressing force of the elastic member. That is, the elastic member may preferably be constructed so that the spring constant is also switched to a large value when the amount of elastic deformation of the elastic member is changed from a small state to a large state at the time of movement of the displaying follower wheel in the direction opposite to the direction to enter between the drive wheel and the displaying transmission wheel. When constructed in this way, at the time of occurrence of display jumping on the displaying follower wheel, since the displaying transmission wheel must be greatly displaced in the direction opposite to the direction to enter between the drive wheel and the displaying follower wheel, the elastic member greatly elastically deforms and the spring constant becomes large. Therefore, the displaying transmission wheel positively positions the displaying follower wheel. Nevertheless, at the time of the normal display-feeding operation, the displaying transmission wheel is not displaced greatly, so that the amount of elastic deformation of the elastic member is small, and the spring constant is also small. Accordingly, the load between the displaying transmission wheel and the drive wheel, and the load between the displaying transmission wheel and the displaying follower wheel may become light.

In constructing the device in this way, the elastic member may consist of one spring comprising a first deformation portion which keeps on imparting the lateral pressure in the direction to enter between the drive wheel and the displaying follower wheel to the displaying transmission wheel, and a second deformation portion which starts imparting the lateral pressure in the direction to enter between the drive wheel and the displaying follower wheel to the displaying transmission wheel from midway of movement of the displaying transmission wheel in the direction opposite to the direction to enter between the drive wheel and the displaying follower wheel. When constructed in this way, the second deformation portion may preferably have a spring constant larger than that of the first deformation portion. When constructed in this way, since the spring constant is large at the time of occurrence of display jumping on the displaying follower wheel, the displaying transmission wheel positions the displaying follower wheel more positively. In addition, since the spring constant is small during the normal display-feeding operation, the load between the displaying transmission wheel and the drive wheel, and the load between the displaying transmission wheel and the displaying follower wheel may be minimal.

In addition, the elastic member may consist of a first spring which keeps on imparting the lateral pressure in the direction to enter between the drive wheel and the displaying follower wheel to the displaying transmission wheel, and a second spring which starts imparting the lateral pressure in the direction to enter between the drive wheel and the displaying follower wheel to the displaying transmission wheel from midway of movement of the displaying transmission wheel in the direction opposite to the direction to enter between the drive wheel and the displaying follower wheel. When constructed in this way, the second spring may preferably have a spring constant larger than that of the first spring. When constructed in this way, since the spring constant is also large at the time of occurrence of the display jumping on the displaying follower wheel, the displaying transmission wheel positions the displaying follower wheel more positively. In addition, since the spring constant is small during the normal display-feeding operation, the load between the displaying transmission wheel and the drive wheel, and the load between the displaying transmission wheel and the displaying follower wheel may become light.

In the present invention, it is preferable to achieve a reduction in size of the display device by arranging the elastic member so that at least a part thereof overlap displaying follower wheel so as to compact an area occupied by the elastic member, and to achieve a reduction in size of the display device.

In contrast, if the elastic member and the displaying follower wheel are arranged on substantially the same plane, there is an advantage in that the reduction in thickness of the display device can be achieved. That is, if the elastic member is arranged so as not to overlap the displaying follower wheel in plan view, there is an advantage in that the reduction in thickness of the display device can be achieved.

In the present invention, the drive wheel may rotationally drive the displaying transmission wheel so that an action force heading toward the same direction as the direction of the application of the lateral pressure is generated on the displaying transmission wheel. In this case, at the position on the side of the direction of the application of the lateral pressure with respect to the displaying transmission wheel, a stopper for preventing the displaying transmission wheel from entering excessively between the drive wheel and the displaying follower wheel may preferably be arranged by utilizing the wall of a main plate or the like.

In contrast with this, the drive wheel may rotationally drive the displaying transmission wheel so that an action force heading toward the direction opposite to the direction of the application of the lateral pressure is generated on the displaying transmission wheel. That is, the drive wheel may be constructed so as to drive rotationally the displaying transmission wheel in the direction to resist the lateral pressure. When constructed in the way, the amount of displacement of the displaying transmission wheel when the displaying transmission wheel is rotationally driven by the drive wheel may become small, so that there is an advantage in that the displaying transmission wheel can be easily supported. In addition, when constructed in this way, the mesh between the drive wheel and the displaying transmission wheel becomes slight, so that the load due to the stretch of the teeth can be lightened.

In the present invention, a clutch mechanism for switching a driving force transmission path extending from the drive wheel to the displaying follower wheel via the displaying transmission wheel between a connected state and an interrupted state may be preferably further constructed in the transmission path. When constructed in this way, the driving force transmission path can be interrupted with the clutch mechanism, so that the displaying follower wheel can be rapid-fed in either the same direction as that of the display feeding and the direction opposite thereto, and the displayed matters can be corrected.

In the present invention, the lateral pressure-imparting means may utilize the elastic deformation of the displaying transmission wheel.

According to the present invention, the drive wheel and the displaying transmission wheel may be preferably formed of different materials so as to reduce wear thereof.

In the present invention, a process for increasing lubricity may preferably be given to at least one of the drive wheel and the displaying transmission wheel. When constructed in this way, lubricating oil is not required, so that a generation of a ringing load and a stain due to the lubricating oil can be prevented.

Since the thus constructed display device can achieve a reduction in power consumption, it is suitable for use in calendar display of a watch, such as a wristwatch and a clock.

Reference Numerals

1 wristwatch
21A, 21B, 21D, 29D holes for supporting rotating central shifts
3 drive section
31 drive wheel (drive wheel)
5 calendar display device
50 feed mechanism
6A, 6B, 6D displaying follower wheels
7 lateral pressure-imparting mechanism
7A, 7B, 7D displaying follower wheels
70A, 70B, 70D, 79D rotating central shafts of displaying transmission wheels
8A, 8B, 8D, 80D springs (elastic members)
9 display-correcting rapid feed mechanism

BEST MODE FOR CARRYING OUT THE INVENTION

Embodiments of the present invention will be described with reference to the drawings.

First Embodiment

Figure 1:
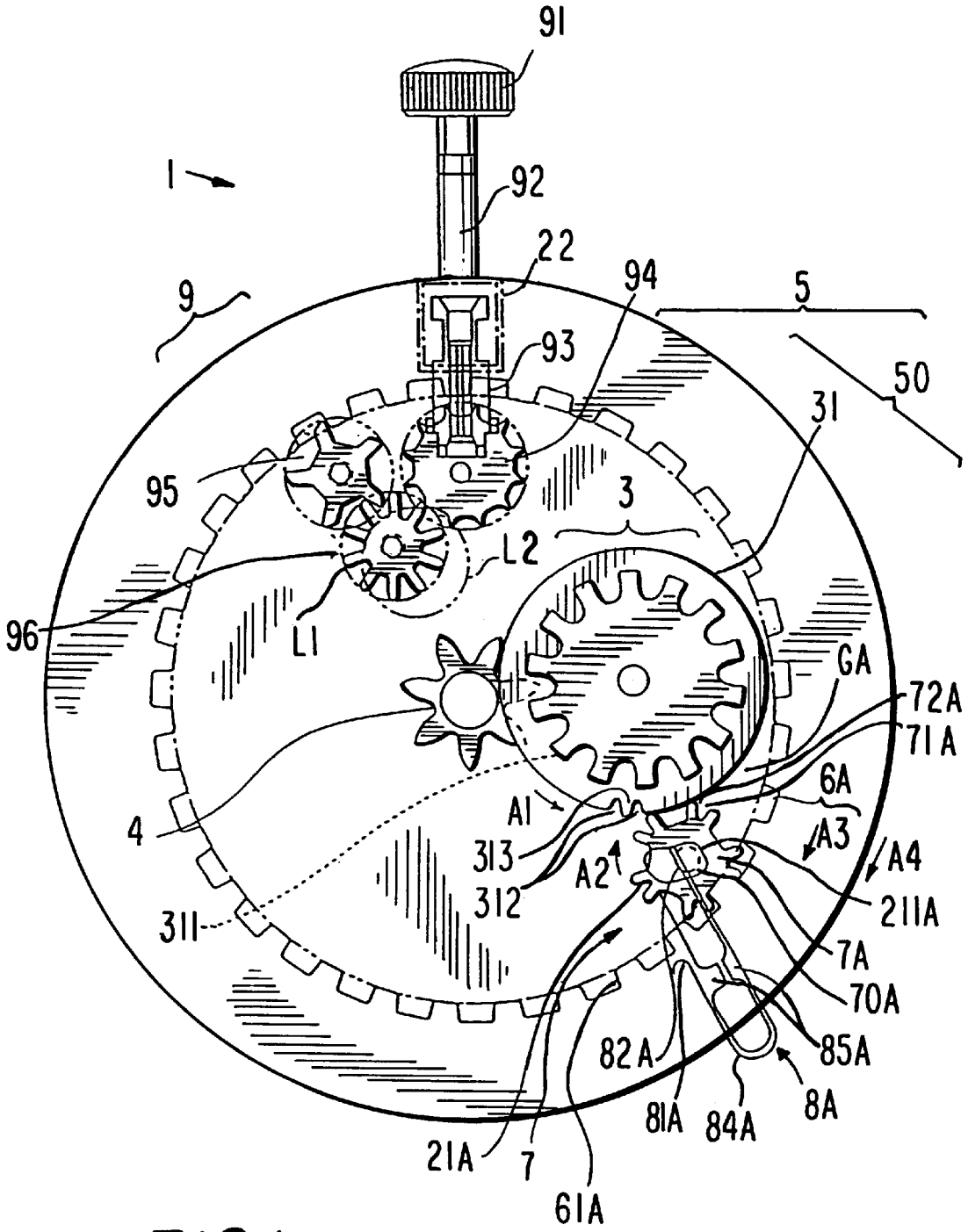
FIG. 1 is a plan view showing the arrangement of respective components constituting a main part of a calendar display device of a wristwatch according to a first embodiment of the present invention.
Figure 2:
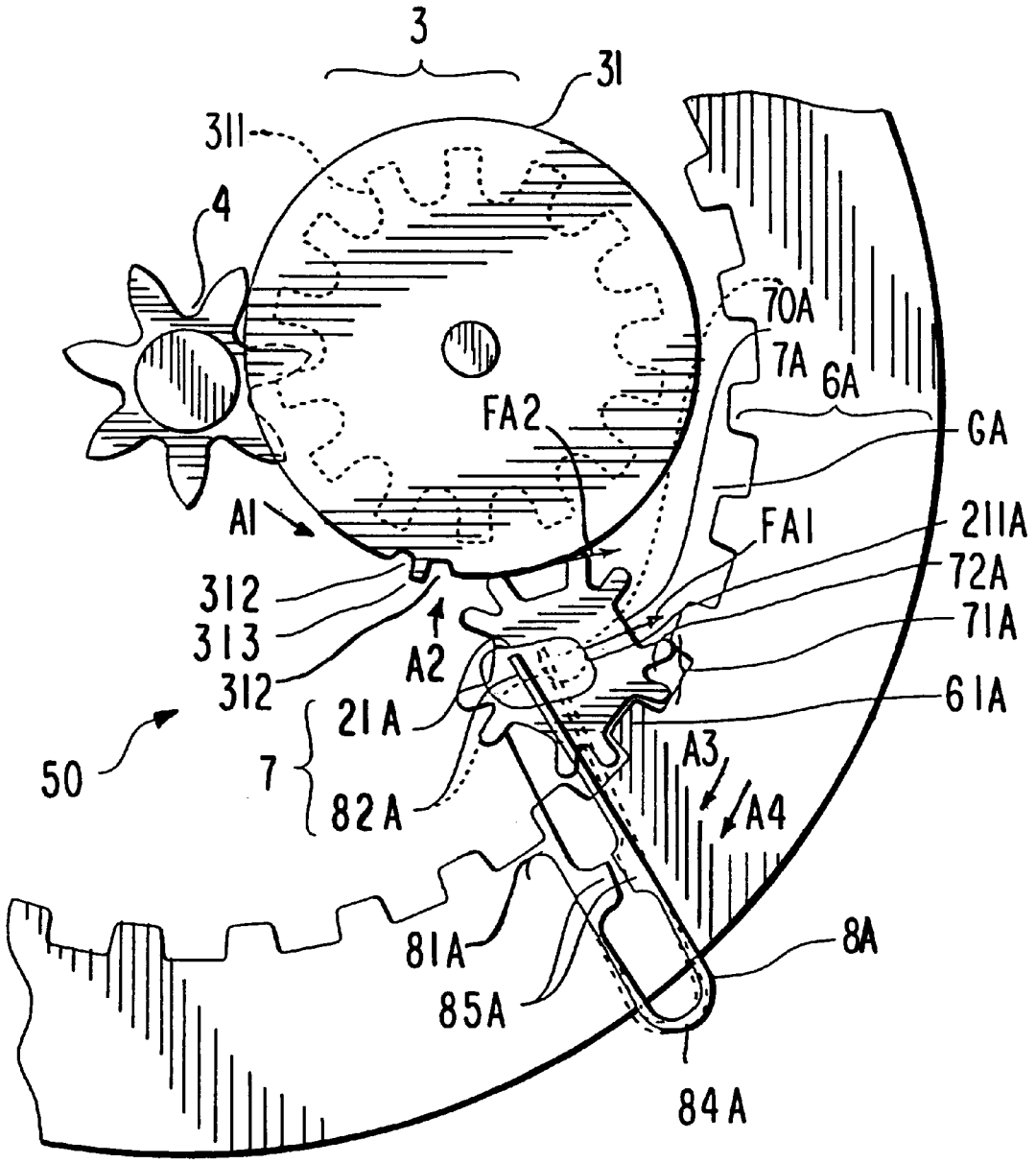
FIG. 2 is an enlarged view of a driving force transmission part in a feed mechanism of the calendar display device shown in FIG. 1.
Figure 3:
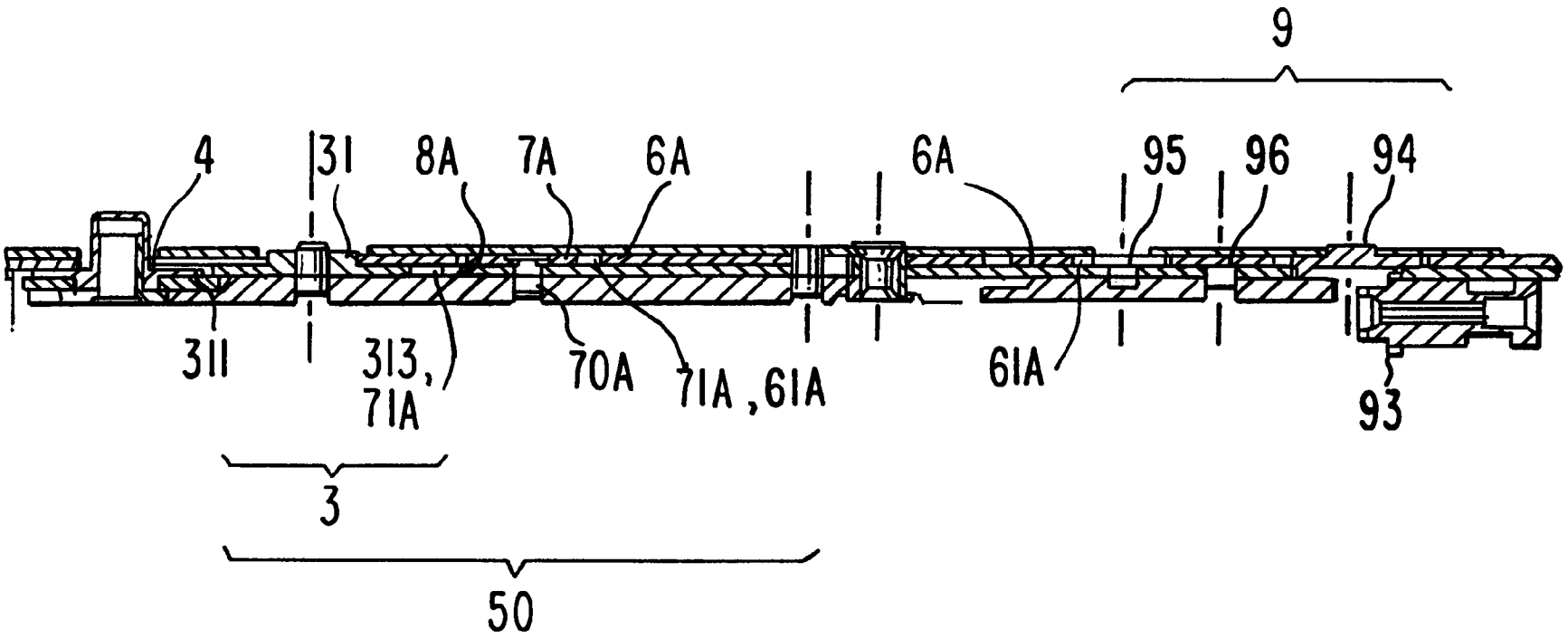
FIG. 3 is a vertical sectional view in which a train wheel is developed to schematically show the engagement states of respective components in the calendar display device shown in FIG. 1.

FIG. 1 is a plan view showing the arrangement of respective components constituting a main part of a calendar display device of a wristwatch according to a first embodiment of the present invention, FIG. 2 is an enlarged view of a driving force transmission part in a feed mechanism of this calendar display device, and FIG. 3 is a vertical sectional view in which a train wheel is developed to schematically show the engagement states of respective components in this calendar display device.

In FIG. 1 and FIG. 2, in a main body of a wristwatch 1, a drive wheel 31 (drive wheel) in a drive section 3 includes a step motor (not shown), to which a rotational driving force is transmitted from the step motor, to be rotated once in 24 hours is constructed. An external tooth 311 for use in time display is meshed with a gear 4 of an hour wheel for use in time display.

In addition, in the wristwatch 1, there is constructed a calendar display device 5 for switching a date display and a day display at a display window 22 formed in the direction of 3 o'clock of a dial. A feed mechanism 50 of this calendar display device 5 has a Geneva structure comprising a ring-shaped displaying follower wheel 6A (a date indicator of a display section/displaying follower wheel) on which numerals for displaying the date are printed; and a displaying transmission wheel 7A which engages with both the displaying follower wheel 6A and the drive wheel 31 to transmit the rotation of the drive wheel 31 to the displaying follower wheel 6A, and similar to the time displaying, displays date by making use of a rotational driving force transmitted from the drive wheel 31.

Since the displaying follower wheel 6A is ring-shaped and has no rotating central shaft, in this embodiment, a guide mechanism (not shown) making use of pins and dowels is constructed on the inner peripheral side or the outer peripheral side of the displaying follower wheel 6A to guide follower wheel 6A during positioning.

The drive wheel 31 has a projection formed on the outer periphery thereof that is equivalent to one external tooth 313 projecting between two recesses 312, while the ring-shaped displaying follower wheel 6A has 31 pieces of internal teeth 61A formed on the inner periphery thereof at intervals of the same angle. The displaying transmission wheel 7A has five pieces of external teeth 71A formed on the outer periphery thereof at intervals of the same angle, each tooth consisting of a pair of two projections projecting in such a manner as to sandwich a recess 72A.

In the thus constructed train wheel, the external tooth 313 is engaged with the recess 72A of the displaying transmission wheel 7A, whereby the displaying transmission wheel 7A is externally meshed with the drive wheel 31, and when the drive wheel 31 is rotated in the direction shown by the arrow A1, transmission wheel 7A is rotated in the direction shown by the arrow A2 in association with the rotation of the drive wheel 31. In addition, the external teeth 71A, each consisting of two projections of the displaying transmission wheel 7A, are engaged with the recesses of the internal teeth 61A of the displaying follower wheel 6A, whereby the displaying transmission wheel 7A is internally meshed with the displaying follower wheel 6A, transmits the rotation of the drive wheel 31 to the displaying follower wheel 6A as the rotation in the direction shown by the arrow A3 (normal direction), and performs switching of the calendar display.

In this way, projections and recesses constituting the external teeth 71A on the outer periphery of one displaying transmission wheel 7A are used to both mesh between the outer periphery of the drive wheel 31 and the outer periphery of the displaying transmission wheel 7A and mesh between the inner periphery of the displaying follower wheel 6A and the outer periphery of the displaying transmission wheel 7A, so that it is not necessary for the displaying transmission wheel 7A to include two two gears bonded one to the other and offset in an axial direction so as to permit one of the gears to engage drive wheel 31 and the other gear to engage displaying follower wheel 6A. For this reason, as shown in FIG. 3, the drive wheel 31, the displaying transmission wheel 7A and the displaying follower wheel 6A can be arranged on the same plane, so that the feed mechanism 50 of the calendar display device 5 can be reduced in thickness. That is, a reduction in thickness of the feed mechanism 50 of the calendar display device 5 can be achieved by arranging the drive wheel 31, the displaying transmission wheel 7A and the displaying follower wheel 6A so as not to overlap each other in a plan view. Therefore, a reduction in thickness of the wristwatch 1 can be achieved.

In FIG. 2 again, in the feed mechanism 50, there is constructed a lateral biasing mechanism 7 for elastically biasing the displaying transmission wheel 7A in the direction (shown by the arrow FA1) between the drive wheel 31 and the displaying follower wheel 6A. In this lateral biasing mechanism 7, a rotating central shaft 70A of the displaying transmission wheel 7A is supported in a hole 21A (support means) formed in a train wheel bridge or a main plate (not shown). This hole 21A extends so as to be along the outer periphery of the drive wheel 31 from the outside of a gap GA formed by the drive wheel 31 and the displaying follower wheel 6A toward the inner part thereof, so that the displaying transmission wheel 7A can move between the outside and the inner part of the gap GA within the formation range of the hole 21A. In addition, when viewed from the rotating central shaft 70A of the displaying transmission wheel 7A, a spring 8A (elastic member) made of a substantially U-shaped thin plate of which a base 81A is supported by the aforementioned train wheel bridge and main plate is arranged outside the gap GA. A tip 82A of this spring 8A presses, as shown by the arrow FA1, the rotating central shaft 70A of the displaying transmission wheel 7A to the inner part of the gap GA with elasticity. Moreover, since the drive wheel 31 and the displaying follower wheel 6A form the gap GA whose width becomes narrower toward the inner part thereof, the pressing force (lateral pressure) of the spring 8A presses the outer periphery of the displaying transmission wheel 7A onto the outer periphery of the drive wheel 31 and the inner periphery of the displaying follower wheel 6A so as to fill up looseness (clearance) between the drive wheel 31 and the displaying transmission wheel 7A and, between the displaying follower wheel 6A and the displaying transmission wheel 7A with elasticity.

However, the direction (direction shown by the arrow FA1) in which the spring 8A presses the displaying transmission wheel 7A is substantially parallel to the direction (direction shown by the arrow FA2) of the tangent to the contact position of the drive wheel 31 and the displaying transmission wheel 7A, of the outer peripheral contour circle of the drive wheel 31. That is, the direction (direction shown by the arrow FA1) in which the spring 8A presses the displaying transmission wheel 7A is the circumferential direction of the outer peripheral contour circle of the drive wheel 31 at the intersection of the outer peripheral contour circle and a line connecting both center points of rotation of the drive wheel 31 and the displaying transmission wheel 7A. For this reason, the spring 8A presses the rotating central shaft 70A in the direction inclined toward the displaying follower wheel 6A between the drive wheel 31 and the displaying follower wheel 6A. Therefore, a pressing force of the displaying transmission wheel 7A in the direction of a normal line at the position contacting the drive wheel 31 and the displaying follower wheel 6A is larger at the displaying follower wheel 6A than that at the drive wheel 31.

In addition, the displaying transmission wheel 7A serves as a wedge to generate a high load when it is pressed by the spring 8A to enter deeply into the inner part of the gap GA. In this embodiment, however, since the edge of the hole 21A becomes a wall 211A (stopper) against the displaying transmission wheel 7A, the displaying transmission wheel 7A will not enter into the gap GA further.

In addition, since the hole 21A extends to the outside of the gap GA formed by the drive wheel 31 and the displaying follower wheel 6A, when the displaying follower wheel 6A is rotated as shown by the arrow A4 at the time of performing the correction of the date display, as described later, the displaying transmission wheel 7A receiving this force from the displaying follower wheel 6A retracts toward the outside from between the drive wheel 31 and the displaying follower wheel 6A.

Referring back to FIG. 1, in this embodiment, there is constructed a display-correcting rapid feed mechanism 9 for performing the correction of the date display by rotating the displaying follower wheel 6A in rapid-feeding without the aid of the drive wheel 31 and the displaying transmission wheel 7A. In this display-correcting rapid feed mechanism 9, there are constructed a winding stem 92, having a crown 91 fixed to the outer end portion thereof, a sliding pinion 93 fixed to the winding stem 92, a first display-correcting transmission wheel 94 to which the rotation of the sliding pinion 93 is transmitted, a second display-correcting transmission wheel 95 which is internally meshed with the displaying follower wheel 6A, and a third display-correcting transmission wheel 96 which shifts to a position where it is meshed with the second display-correcting transmission wheel 95 when the crown 91 is pulled out and the crown 91 is rotated in the correction direction for the date display. Therefore, if the crown 91 is pulled out and the crown 91 is rotated in the correction direction for the date display, the third display-correcting transmission wheel 96 shifts from the position shown by the two-dot chain line L2 to the position shown by the two-dot chain line L1 to be meshed with the second display-correcting transmission wheel 95, so that the rotational action of the crown 91 is transmitted to the displaying follower wheel 6A as the rotation in the direction of the arrow A4 through the sliding pinion 93 of the winding stem 92, the first display-correcting transmission wheel 94, the third display-correcting transmission wheel 96 and the second display-correcting transmission wheel 95. Therefore, it is possible to rapid-feed manually the displaying follower wheel 6A. However, in a state where the crown 91 is pressed, the sliding pinion 93 shifts from the engagement position with the first display-correcting transmission wheel 94 and the engagement thereof is released, so that an excessive load is not applied to the drive wheel 31 and the displaying transmission 7A when the displaying follower wheel 6A is allowed to perform a normal calendar-feeding operation through the drive wheel 31 and the displaying transmission wheel 7A.

In the thus constructed calendar display device 5, if the rotational driving force from the aforementioned step motor is transmitted to allow the drive wheel 31 to rotate once in 24 hours as shown by the arrow A1, and the external tooth 311 reaches a predetermined position, the drive wheel 31 is meshed with the external teeth 71A of the displaying transmission wheel 7A. As a result, the displaying transmission wheel 7A stops after rotating by an angle of 72° (by one step) in 24 hours in the direction shown by the arrow A2. During this period, the displaying transmission wheel 7A rotates the displaying follower wheel 6A, which is internally meshed therewith through the external teeth 71A and the internal teeth 61A, about by 11.6° (by one step) in 24 hours to advance the display effected at a display window 22 by one day and then stops.

When such a normal calendar feeding is performed, since the feed mechanism 50 of the calendar display device 5 has the Geneva structure, the displaying transmission wheel 7A rotates smoothly if meshed with the drive wheel 31 during the calendar feeding, and the driving force can be efficiently transmitted.

In addition, the displaying transmission wheel 7A is pressed by the spring 8A to elastically take up play between the engagement portion and the drive wheel 31 and play between the engagement portion and the displaying follower wheel 6A, so that the play is prevented to such an extent that a load or the like due to a stretch of the teeth can be avoided. Further, the jumper spring is not used for the prevention of the display jumping of the displaying follower wheel 6A. Accordingly, no excessive load is generated between the displaying transmission wheel 7A and the drive wheel 31 and between the displaying transmission wheel 7A and the displaying follower wheel 6A, so that a reduction in power consumption of the wristwatch 1 (the calendar display mechanism 5) can be achieved.

Here, although the hole 21A extends to the inside of the gap GA so that the displaying transmission wheel 7A fills up the looseness of the engagement portions between the drive wheel 31 and the displaying follower wheel 6A, during the interval of the normal calendar feeding, the rotating central shaft 70A is located at the position near the center of the hole 21A and is not in contact with the inner periphery of the hole 21A (see FIG. 1). From this state, if the normal calendar feeding is performed, the direction of the force applied from the drive wheel 31 to the displaying transmission wheel 7A is the same as the direction in which the spring 8A presses the displaying transmission wheel 7A (the direction of lateral pressure), and is the direction to press the displaying transmission wheel 7A deeply into the gap GA. For this reason, when the drive wheel 31 rotationally drives the displaying transmission wheel 7A, the displaying transmission wheel 7A may excessively enter into the inner part of the gap GA. In this embodiment, however, since the rotating central shaft 70A strikes the wall 211A of the hole 21A (see FIG. 2), it will not further enter between the drive wheel 31 and the displaying follower wheel 6A. Therefore, the load generated between the drive wheel 31 and the displaying transmission wheel 7A due to the stretch of the teeth, and the load generated between the displaying transmission wheel 7A and the displaying follower wheel 6A due to the stretch of the teeth can be reduced. Accordingly, a reduction in power consumption at the time of performing the calendar feeding can be achieved.

In addition, the hole 21A has a wide width when viewed from the diameter of the rotating central shaft 70A, so that the displaying transmission wheel 7A can move in either direction toward the drive wheel 31 and toward the displaying follower wheel 6A (the direction perpendicular to the direction of the lateral pressure). For this reason, the displaying transmission wheel 7A shifts to the most suitable position by the balance between the force received from the drive wheel 31 and the force received from the displaying follower wheel 6A. For this reason, the displaying transmission wheel 7A can positively fill up the looseness between the displaying transmission wheel 7A and the drive wheel 31, and between the displaying transmission wheel 7A and the displaying follower wheel 6A with a proper force, so that the rattle peculiar to the Geneva structure can be positively prevented.

Further, even during the interval of the calendar feeding, the displaying transmission wheel 7A is pressed by the spring 8A to fill up the looseness between the engagement portions with the drive wheel 31 and the looseness between the engagement portions with the displaying follower wheel 6A in the form of a wedge. In such a Geneva structure, during the interval of the calendar feeding, the outer periphery of the displaying transmission wheel 7A is positioned in a state of contacting the outer periphery of the drive wheel 31 and the inner periphery of the displaying follower wheel 6A, resulting in positioning the displaying follower wheel 6A. Therefore, the displaying follower wheel 6A is not freely moved by disturbance or the like, so that the display jumping can be prevented. Thus, the calendar display device 5 in which the feeding operation load is light and display jumping does not occur can be realized.

Moreover, the spring 8A presses the rotating central shaft 70A of the displaying transmission wheel 7A in the direction inclined toward the displaying follower wheel 6A, so that the displaying transmission wheel 7A positively positions the displaying follower wheel 6A. In contrast, the displaying transmission wheel 7A only presses the outer periphery of the drive wheel 31 with a force somewhat weaker than the force toward the displaying follower wheel 6A, so that the frictional load torque between the drive wheel 31 and the displaying transmission wheel 7A is low during the interval of the normal calendar feeding operation.

In addition, in this embodiment, the spring 8A is abutted against the rotating central shaft 70A in applying a lateral pressure to the displaying transmission wheel 7A, so that it is easy to set the direction and the magnitude of the force for pressing the displaying transmission wheel 7A to the most suitable conditions, and the structure of the displaying follower wheel 6A without the shift of the position and the display jumping can be easily formed. Moreover, the tip 82A of the spring 8A is in contact with the rotating central shaft 70A, and the diameter of the rotating central shaft 70A is small. Therefore, a frictional load torque can be lowered according to low friction at the contact portion of the spring 8A and the rotating central shaft 70A when the drive wheel 31 rotates the displaying transmission wheel 7A, so that this is suitable for a reduction in power consumption.

Further, if the crown 91 is pulled out and rotated in the correction direction for the date display when the date display is intended to be corrected in the calendar display device 5 in this embodiment, the second display-correcting transmission wheel 95 is meshed with the third display-correcting transmission wheel 96 to rapid-feed the displaying follower wheel 6A in the direction shown by the arrow A4 without the aid of the drive wheel 31 and the displaying transmission wheel 7A. At this time, if the position of the displaying transmission wheel 7A is completely fixed, a heavy load is applied from the displaying transmission wheel 7A and the drive wheel 31 when rotating the displaying follower wheel 6A. In this embodiment, however, the displaying transmission wheel 7A is movable within the formation range of the hole 21A, and the displaying transmission wheel 7A is merely engaged with the displaying follower wheel 6A by the pressing force of the spring 8A. Accordingly, when rapid-feeding the displaying follower wheel 6A through the crown 91, by receiving the force thereof, the displaying transmission wheel 7A is pressed from the inner part of the gap GA to the outside, so that the engagement between the displaying transmission wheel 7A and the displaying follower wheel 6A is released. Thus, manually rapid-feeding the displaying follower wheel 6A is smooth. In addition, when returning to the state of the normal calendar feeding from a rapid-feeding state, the displaying transmission wheel 7A can shift in either direction toward the drive wheel 31 and toward the displaying follower wheel 6A (the direction perpendicular to the direction of the lateral pressure) in the hole 21A, so that the displaying transmission wheel 7A smoothly returns to the state of re-engagement with the drive wheel 31 and the displaying follower wheel 6A.

In addition, in this embodiment, as will be apparent from FIG. 1 and FIG. 2, on the spring 8A, there are constructed a curved portion 84A, the tip 82A elongating from the curved portion 84 to abut against the rotating central shaft 70A of the displaying transmission wheel 7A, and stopper portions 85A striking each other between the tip 82A and the base 81A thereby preventing a further deformation of the curved portion 84A. For this reason, one spring 8A has two elastically deformation portions at the curved portion 84A (first deformation portion) and at the tip 82A (second deformation portion). That is, although the curved portion 84A elastically deforms with a relatively small spring constant, in the course of moving of the displaying transmission wheel 7A in the direction opposite to the direction to enter between the drive wheel 31 and the displaying follower wheel 6A, after striking of the stopper portions 85A, the tip 82A starts deforming with a large spring constant using the striking portion as a fulcrum. Therefore, although the spring 8A has two spring constants, the spring constants also change to large values when an amount of elastic deformation changes from small to large. For this reason, when the display jumping of the displaying follower wheel 6A occurs, since the displaying transmission wheel 7A must be greatly displaced in the direction opposite to the direction to enter between the drive wheel 31 and the displaying follower wheel 6A, the spring 8A greatly elastically deforms and the spring constants become large. Therefore, the displaying transmission wheel 7A positively positions the displaying follower wheel 6A. Nevertheless, at the time of the normal display-feeding operation, the amount of elastic deformation of the spring 8A is small, and the spring constants remain small. Accordingly, the load between the displaying transmission wheel 7A and the drive wheel 31, and the load between the displaying transmission wheel 7A and the displaying follower wheel 6A may become light. Thus, the display jumping can be positively prevented while achieving a reduction of power consumption during the calendar-feeding operation.

In addition, the spring 8A is arranged so that a major portion thereof overlaps the displaying follower wheel 6A. For this reason, it is not necessary to provide a special space for the arrangement of the spring 8A, so that this is suitable for reducing the thickness of the wristwatch 1. In contrast, as in the embodiment 2 to be described later, the arrangement of the spring 8A on one plane with the displaying follower wheel 6A is suitable for reducing the thickness of the wristwatch 1.

Figure 4:
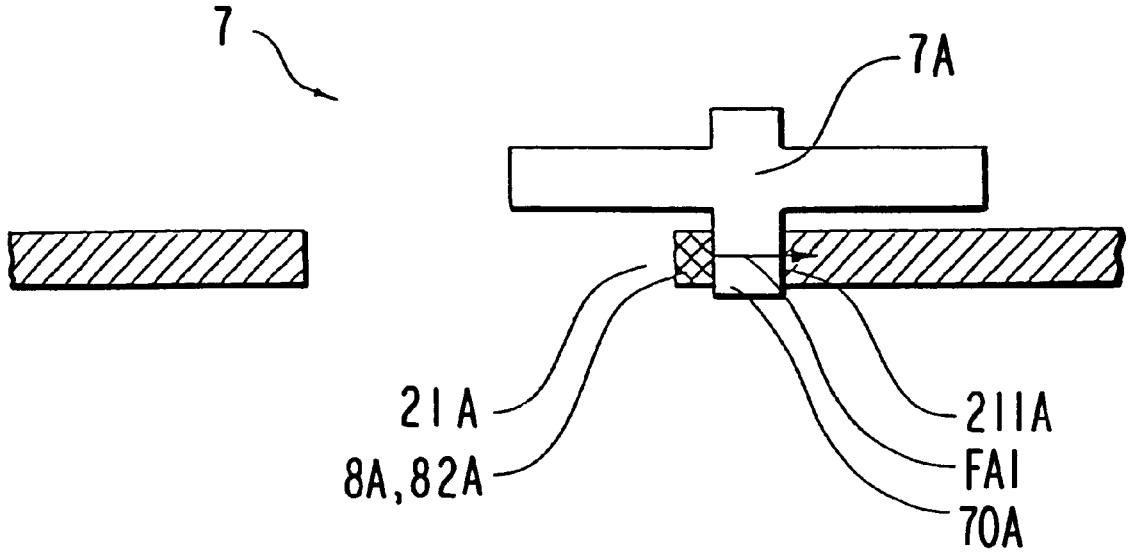
FIG. 4 is an illustration showing a state where a lateral pressure is imparted to a central axis of rotation of a displaying transmission wheel in the calendar display device shown in FIG. 1.

Further, as shown in FIG. 4, in the lateral pressure-imparting mechanism 7, the tip 82A of the spring 8A abuts against the rotating central shaft 70A of the displaying transmission wheel 7A at the position opposing the edge (the wall 211A/stopper) of the hole 21A formed in the main plate and the like so as to impart the lateral pressure heading toward the wall 211A to the displaying transmission wheel 7A. For this reason, even if the rotating central shaft 70A of the displaying transmission wheel 7A is pressed by the tip 82 of the spring 8A to strike the wall 211A, the rotating central shaft 70A of the displaying transmission wheel 7A does not tilt. Accordingly, the load applied when the drive wheel 31 rotates the displaying transmission wheel 7A, and the load applied when the displaying transmission wheel 7A rotates the displaying follower wheel 6A can be reduced.

Second Embodiment

Figure 5:
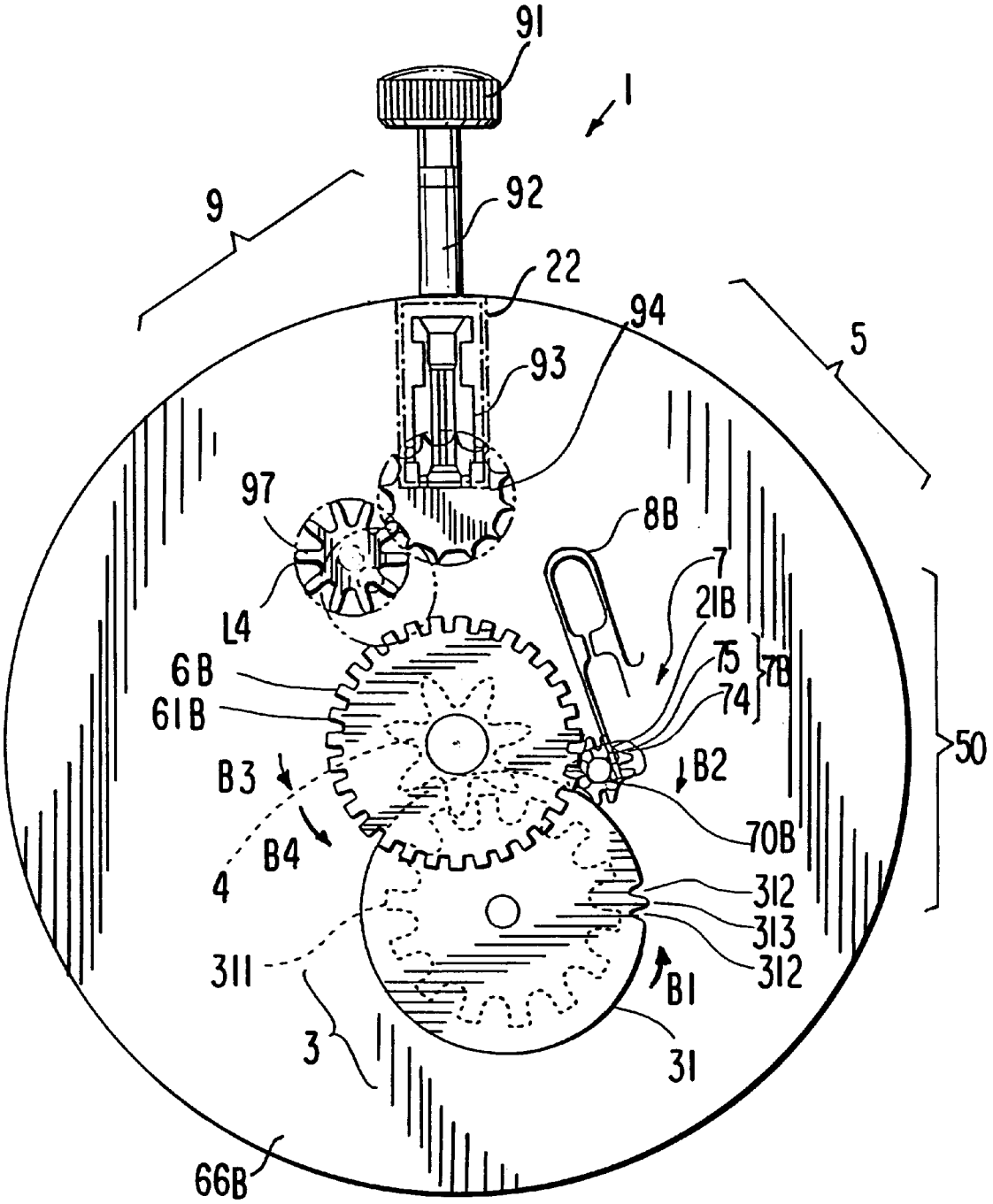
FIG. 5 is a plan view showing the arrangement of respective components constituting a main part of a calendar display device of a wristwatch according to a second embodiment of the present invention.
Figure 6:
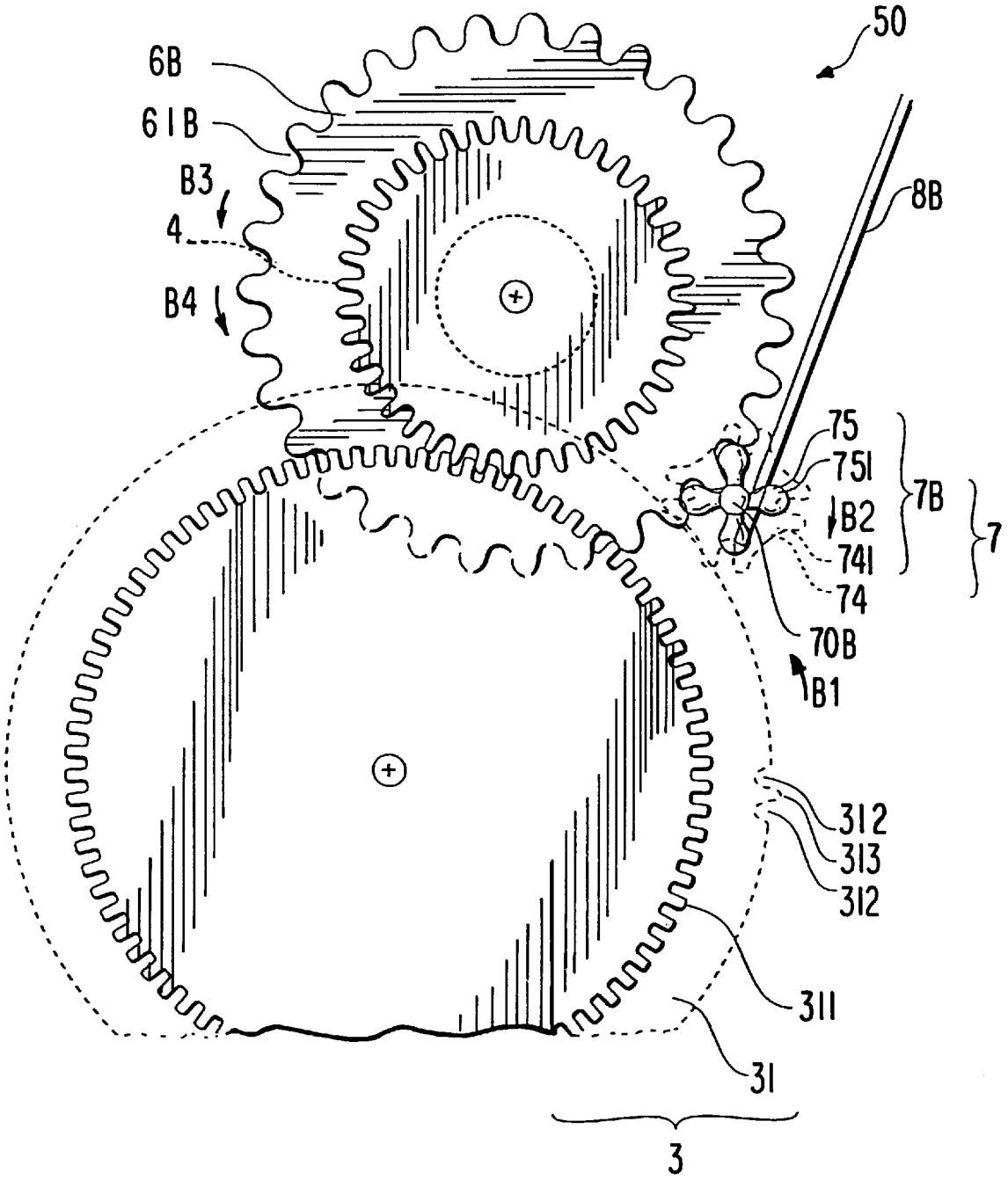
FIG. 6 is an enlarged view of a driving force transmission part in a feed mechanism of the calendar display device shown in FIG. 5.
Figure 7:
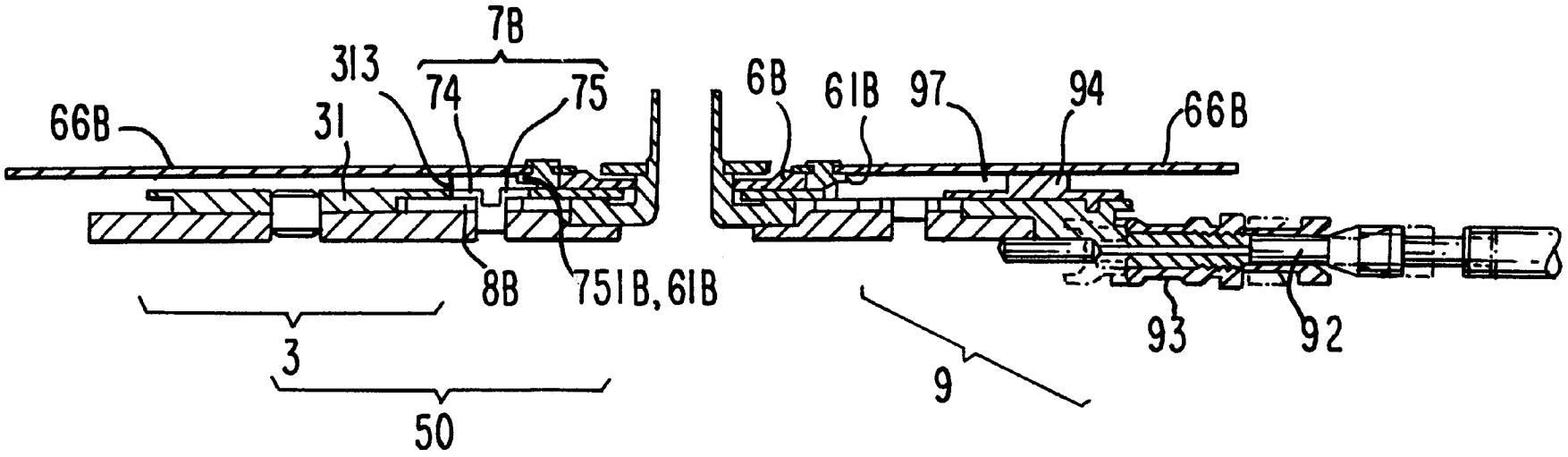
FIG. 7 is a vertical sectional view in which a train wheel is developed to schematically show the engagement states of respective components in the calendar display device shown in FIG. 5.

FIG. 5 is a plan view showing the arrangement of respective components constituting a main part of a calendar display device of a wristwatch according to a second embodiment of the present invention, FIG. 6 is an enlarged view of a driving force transmission part in a feed mechanism of this calendar display device, and FIG. 7 is a vertical sectional view in which a train wheel constituting the feed mechanism of the calendar display device is developed to schematically show the engagement states of respective components. Since the basic construction of the calendar display device of this embodiment is similar to that of the embodiment 1, components having the corresponding functions are indicated by the same numerals and a detailed description thereof will be omitted. However, of the components having the corresponding functions, the displaying follower wheel 6A, the displaying follower wheel 6A, and the spring 8A described in the embodiment 1 are shown in the drawings and described as a displaying follower wheel 6B, a displaying follower wheel 6B, and a spring 8B.

As shown in FIG. 5 and FIG. 6, in this embodiment, there is also constructed a drive wheel 31 (drive wheel) in a drive section 3 to which a rotational driving force is transmitted from a step motor (not shown) to be rotated once in 24 hours, and an external tooth 311 formed on the drive wheel 31 for use in time display is meshed with a gear 4 for use in time display.

In a feed mechanism 50 of a calendar display device 5, a ring-shaped wheel comprising an internal tooth is employed as a displaying follower wheel in the embodiment 1. In this embodiment, however, a disk-like displaying follower wheel 6B (a date indicator of a display section/displaying follower wheel) having 31 pieces of external teeth 61B formed on the outer periphery thereof is employed, and an indicator panel 66B on which dates are printed is integrally mounted to the top surface thereof. As to the drive wheel 31, a wheel is employed on which an external tooth 313 is formed on the outer periphery thereof consisting of a projection sandwiched by two recesses 312. Here, a rotational action of the drive wheel 31 is transmitted to the displaying follower wheel 6B through the displaying transmission wheel 7B.

That is, as shown in FIG. 6 and FIG. 7, the displaying transmission wheel 7B is comprised of two gears consisting of a first disk 74, including four pieces of external teeth 741 meshed with the drive wheel 31, and a second disk 75, including four pieces of external teeth 751 meshed with the displaying follower wheel 6B, and wherein the second disk 75 and the first disk 74 are stacked and fixed and use the rotating central shaft 70B in common. Therefore, both disks 74 and 75 are constructed so as to be integrally rotated around or about the rotating central shaft 70B.

In FIG. 5 and FIG. 6, in the thus constructed feed mechanism 50, there is constructed a lateral pressure-imparting mechanism 7 for imparting with elasticity a lateral pressure in the direction to bias the displaying transmission wheel 7B between the drive wheel 31 and the displaying follower wheel 6B. That is, the displaying transmission wheel 7B is supported at the rotating central shaft 70B in a hole 21A formed in a train wheel bridge or a main plate (not shown), and the displaying transmission wheel 7B can move between a position where it enters between the drive wheel 31 and the displaying follower wheel 6B, and a position where it withdraws therefrom within the formation range of the hole 21B. However, the rotating central shaft 70B of the displaying transmission 70B is pressed by a substantially U-shaped spring 8B (elastic member) with elasticity so as to enter between the drive wheel 31 and the displaying follower wheel 6B, and is pressed against the drive wheel 31 and the displaying follower wheel 6B.

In FIG. 5 again, the feed mechanism 50 of the calendar display device 5 of this embodiment also includes a display-correcting rapid feed mechanism 9 for performing the correction of the date display by rotating the displaying follower wheel 6B without the aid of the drive wheel 31 and the displaying transmission wheel 7B. In this display-correcting rapid feed mechanism 9, there are constructed a winding stem 92 having a crown 91 fixed to the outer end portion thereof, a sliding pinion 93 fixed to the winding stem 92, a first display-correcting transmission wheel 94 to which the rotation of the sliding pinion 93 is transmitted, and a second display-correcting transmission wheel 97 which shifts from a position shown by the two-dot chain line L4 to a position shown by the two-dot chain line L3 to be meshed with the displaying follower wheel 6B when the crown 91 is pulled out and rotated in the correction direction for the date display in order to effect the correction of display. Therefore, if the crown 91 is pulled out to be rotated in the correction direction for the date display, the rotational action thereof is transmitted to the displaying follower wheel 6B through the sliding pinion 93 of the winding stem 92, the first display-correcting transmission wheel 94 and the second display-correcting transmission wheel 97, so that it is possible to rapid-feed manually the displaying follower wheel 6B. However, in a state where the crown 91 is pressed, the sliding pinion 93 shifts from the engagement position with the first display-correcting transmission wheel 94 and the engagement thereof is released, so that an excessive load is not applied to the drive wheel 31 and the displaying transmission wheel 7B when the displaying follower wheel 6B is allowed to perform a normal calendar-feeding operation through the drive wheel 31 and the displaying transmission wheel 7B.

In the thus constructed feed mechanism 50 of the calendar display device 5 according to this embodiment, if the rotational driving force from the aforementioned step motor is transmitted and the drive wheel 31 rotates once in 24 hours in the direction shown by the arrow B1, the displaying transmission wheel 7B which is meshed therewith through the first disk 74 stops after rotating by an angle of 90° (by one step) in the direction shown by the arrow B2. During this period, the displaying following wheel 6B which is meshed with the displaying transmission wheel 7B through the second disk 75 rotates by about 11.6° (by one step) in 24 hours in the direction (normal direction) shown by the arrow B3, and advances the date displayed at a display window 22 by one day and then stops.

In this way, the feed mechanism 50 of the calendar display device 5 according to this embodiment has, similar to the first embodiment, the Geneva structure, so that the displaying transmission wheel 7B rotates smoothly if meshed with the drive wheel 31 during a calendar feeding, and the driving force can be efficiently transmitted.

In addition, the displaying transmission wheel 7B is pressed by the spring 8B to fill up looseness between the engagement portion with the drive wheel 31 and looseness between the engagement portion with the displaying following wheel 6B with elasticity, so that the looseness is secured to such a extent that a load due to a stretch of the teeth can be avoided. Further, the jumper spring is not used for the prevention of the display jumping of the displaying follower wheel 6B. Accordingly, an excessive load is not generated between the displaying transmission wheel 7B and the drive wheel 31 and between the displaying transmission wheel 7B and the displaying follower wheel 6B, so that a reduction in power consumption of the wristwatch 1 (the calendar display mechanism 5) can be achieved.

In addition, even during the interval of the calendar feeding, the displaying transmission wheel 7B is pressed by the spring 8B, and fills up both the looseness between the engagement portion with the drive wheel 31 and the looseness between the engagement portion with the displaying follower wheel 6B. Therefore, in the interval of the calendar feeding, the displaying transmission wheel 7B is positioned in the state of contacting the drive wheel 31 and the displaying follower wheel 6B, and positions the displaying follower wheel 6B in this state. Accordingly, the displaying follower wheel 6B is not freely moved by disturbance or the like, so that display jumping can be prevented. Thus, the calendar display device 5 in which the feeding operation load is light and display jumping does not occur can be realized.

In addition, in the display-correcting rapid feed mechanism 9, if the displaying follower wheel 6B is rapid-fed in the opposite direction without the aid of the drive wheel 31 and the displaying transmission wheel 7B, by receiving a force thereof, the displaying transmission wheel 7B is pushed away from the area between the drive wheel 31 and the displaying follower wheel 6B, so that the engagement of the displaying transmission wheel 7B with the displaying follower wheel 6B with the drive wheel 31 is released. Thus, an effect similar to the first embodiment can be obtained at a point where there is no hindrance in manually backward-feeding the displaying follower wheel 6B.

Further, in this embodiment, because the displaying follower wheel 6B is guided by the shaft, the looseness in the radial direction of the displaying follower wheel 6B can be reduced, thereby realizing an advantage of being resistant to date display jumping. Moreover, a reduction in size can be achieved according to the capability of reducing a tooth module of the displaying follower wheel 6B, and the time required for the feed of display can be shortened.

Third Embodiment

Figure 8:
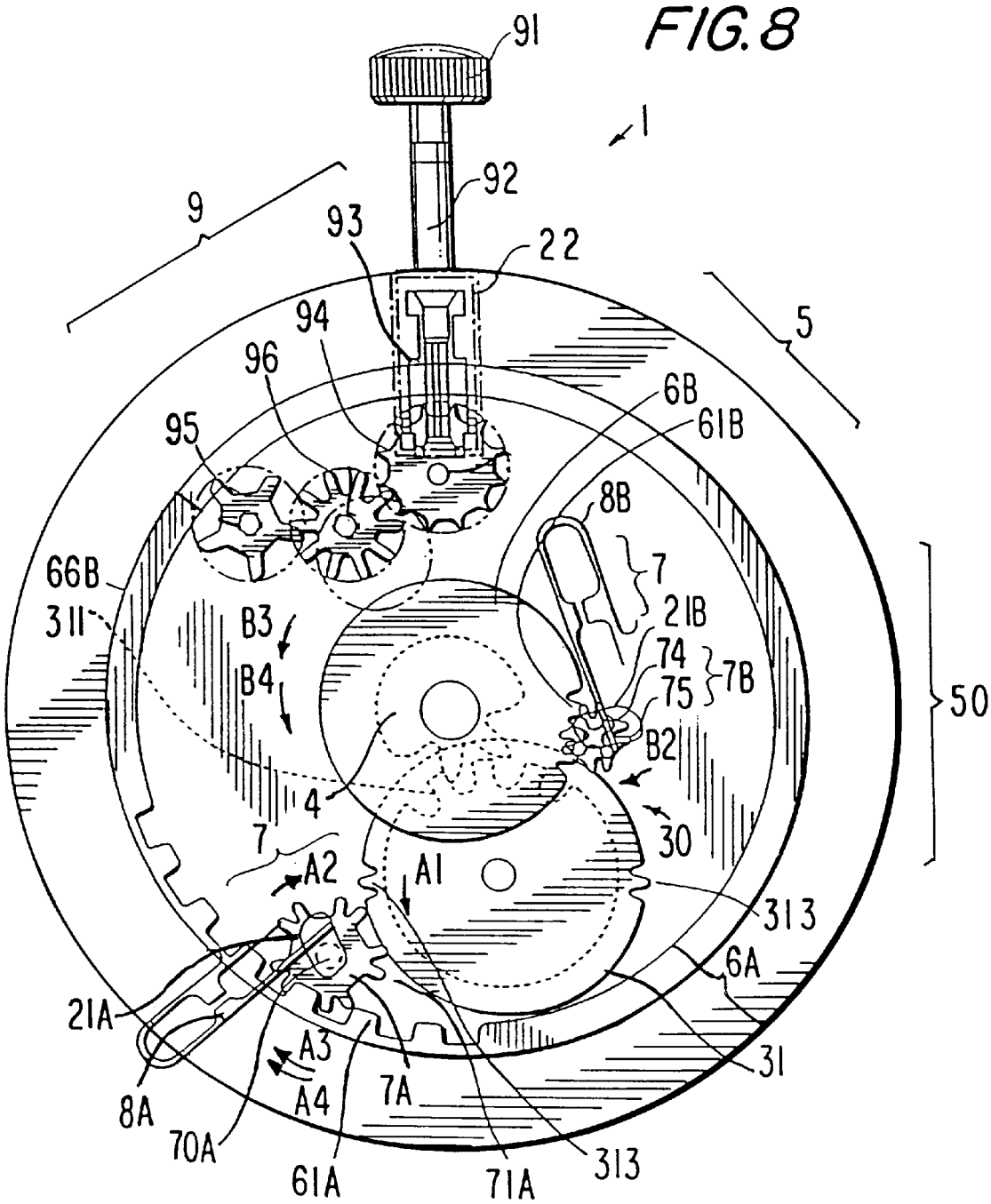
FIG. 8 is a plan view showing the arrangement of respective components constituting a main part of a calendar display device of a wristwatch according to a third embodiment of the present invention.
Figure 9:
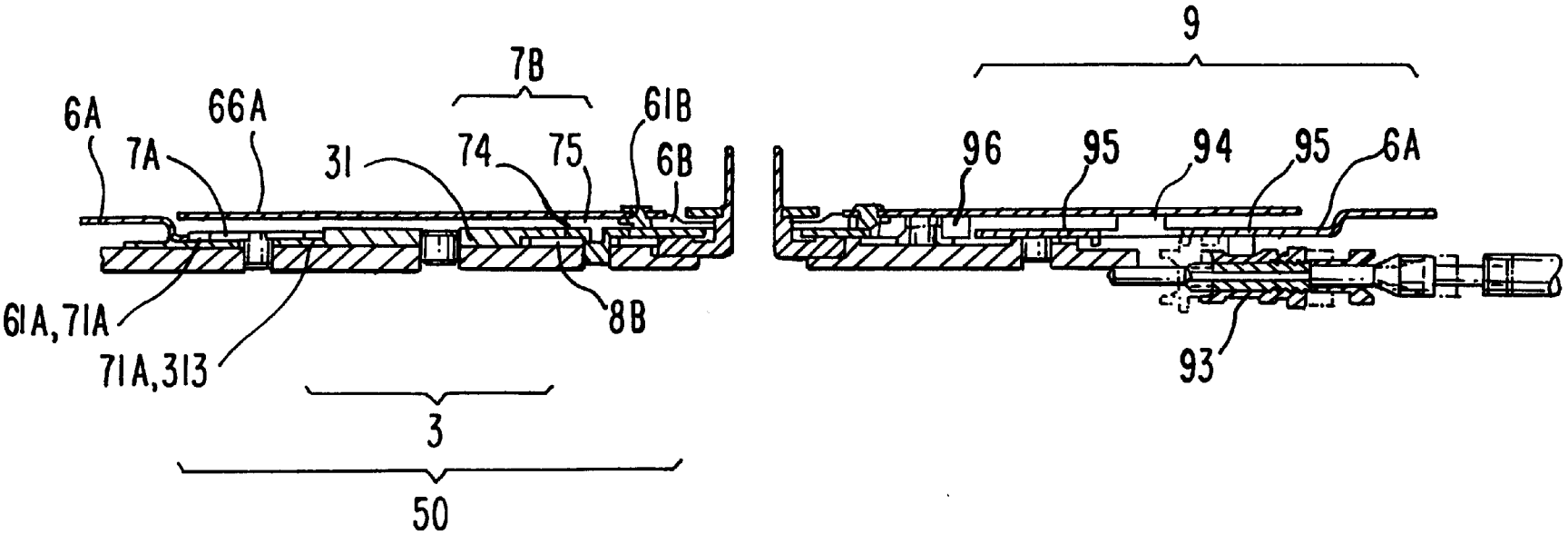
FIG. 9 is a vertical sectional view in which a train wheel is developed to schematically show the engagement states of respective components in the calendar display device shown in FIG. 8.

FIG. 8 is a plan view showing the arrangement of respective components constituting a main part of a calendar display device of a wristwatch according to third embodiment of the present invention, and FIG. 9 is a vertical sectional view in which a train wheel constituting a feed mechanism of this calendar display device is developed to schematically show the engagement states of respective components. The basic construction of the calendar display device of this embodiment is similar to that of the first and second embodiments, the data display performed making use of the construction of the first embodiment, and the day display performed making use of the construction of the second embodiment. For this reason, components having the corresponding functions are indicated by the same numerals and a detailed description thereof will be omitted.

In these drawings, in a main body of the wristwatch 1, there is constructed a drive wheel 31 in a drive section 3 to which a rotational driving force is transmitted from a step motor (not shown) to be rotated once in 48 hours, and external teeth 311 formed on the drive wheel 31 for use in time display are meshed with a gear 4 for use in time display.

In addition, in the wristwatch 1, there is constructed a calendar display device 5 for displaying both date and day. In a feed mechanism 50 of this calendar display device 5, the data and day are also displayed making use of a rotational driving force transmitted from the drive wheel 31.

That is, in the feed mechanism 50 of the calendar display device 5, similar to the first embodiment, a ring-shaped displaying follower wheel 6A (a data indicator of a display section/displaying follower wheel) on which numerals for displaying the data are printed, and a displaying transmission wheel 7A can transmit the rotation of the drive wheel by engaging with both the displaying follower wheel 6A and the drive wheel 31. The drive wheel 31 has, as described in the first embodiment, a projection equivalent to an external tooth 313 formed thereon, but the external tooth 313 are formed on two sections where angle positions are shifted 180°. The displaying follower wheel 6A includes thirty-one pieces of internal teeth 61A. The displaying transmission wheel 7A has five pieces of external teeth 71A foremd thereon, each tooth consisting of a pair of two projections sandwiching a recess. Therefore, the displaying transmission wheel 7A is externally meshed with the drive wheel 31, while internally meshed with the displaying follower wheel 6A, so that the rotation of the drive wheel 31 can be transmitted to the displaying follower wheel 6A.

In this embodiment, the day is displayed making use of the construction similar to that of the second embodiment. That is, in the feed mechanism 50 of the calendar display device 5, there is constructed a disk-like displaying follower wheel 6B (a displaying follower wheel of the display section) having fourteen pieces of external teeth 61B formed on the outer periphery thereof, and an indicator panel 66B (a day indicator of the display section) on which days are printed in bilingual is integrally mounted to the top surface of the displaying follower wheel 6B. The rotation of the drive wheel 31 is transmitted to this displaying follower wheel 6B through the displaying transmission wheel 7B. The displaying transmission wheel 7B comprises, as described in the second embodiment, a first disk 74, including four pieces of external teeth meshed with the drive wheel 31, and a second disk 75, including four pieces of external teeth meshed with the displaying following wheel 6B, and the second disk 75 and the first disk 74 are stacked and fixed and commonly use the rotating central shaft 70B, so that both disks are integrally rotated around the rotating central shaft 70B.

In the thus constructed display feed mechanism 50, similar to the first and second embodiments, there is constructed a lateral pressure-imparting mechanism 7 for imparting with elasticity a lateral pressure in the direction to enter between the drive wheel 31 and the displaying follower wheels 6A, 6B to the displaying transmission wheels 7A, 3B, respectively. That is, the rotating central shafts 70A, 70B of the displaying transmission wheels 7A, 7B are supported in holes 21A, 21B formed in a train wheel bridge or a main plate (not shown), and pressed by substantially U-shaped springs 8A, 8B (elastic members) toward the area between the drive wheel 31 and the displaying follower wheels 6A, 6B. Therefore, the displaying transmission wheels 7A, 7B are pressed against the drive wheel 31 and the displaying follower wheels 6A, 6B.

In addition, in the feed mechanism 50 of the calendar display device 5 of this embodiment, there is also constructed a display-correcting rapid feed mechanism 9 for performing the correction of the data display and the day display by rotating the displaying follower wheels 6A, 6B without the aid of the drive wheel 31 and the displaying transmission wheels 7A, 7B. In this display-correcting rapid feed mechanism 9, there are constructed a winding stem 92 having a crown 91 fixed to the outer end portion thereof, a sliding pinion 93 fixed to the winding stem 92, a first display-correcting transmission wheel 94 to which the rotation of the sliding pinion 93 is transmitted, a second display-correcting transmission wheel 95 which is internally meshed with the displaying follower wheel 6A, and a third display-correcting transmission wheel 96 which shifts to a position where it is meshed with the second display-correcting transmission wheel 95 when the crown 91 is pulled out by one step and rotated in the correction direction for the data display in order to perform the correction of the data display, and which shifts to a position where it is meshed with the displaying follower wheel 6B when the crown 91 is pulled out by one step and rotated in the correction direction for the day display in order to perform the correction of the day display. Here, when the crown 91 is pressed, the engagement of the sliding pinion 93 with the first display-correcting transmission wheel 94 is released, so that an excessive load is not applied to the drive wheel 31 and the displaying transmission wheels 7A, 7B when the displaying follower wheels 6A, 6B are allowed to perform a normal calendar-feeding operation through the drive wheel 31 and the displaying transmission wheels 7A, 7B.

In the thus constructed feed mechanism 50 of the calendar display device 5, if the rotational driving force from the aforementioned step motor is transmitted and the drive wheel 31 rotates once in 48 hours, as shown by the arrow A1, the displaying transmission wheels 7A, 7B meshed therewith stop after rotating by one step in 24 hours, as shown by the arrows A2, B2. During this period, the displaying follower wheels 6A, 6B meshed with the displaying transmission wheels 7A, 7B also rotate by one step in 24 hours, as shown by the arrows A3, B3, and advances the data and day displayed at a display window 22 by one data and then stop. Here, the displaying transmission wheels 7A, 7B are meshed with the drive wheel 31 with different timing. Therefore, because the data feeding and the day feeding are performed with different timing, the load is light.

During the period in which such a normal calendar feeding is performed, in any period equivalent to the interval of the calendar feeding, the displaying transmission wheels 7A, 7B are pressed with elasticity toward the displaying follower wheels 6A, 6B. Therefore, although the feed mechanism 50 has the Geneva structure without the jumper spring, an excessive load is not generated between the displaying transmission wheels 7A, 7B and the drive wheel 31, and between the displaying transmission wheels 7A, 7B and the displaying follower wheels 6A, 6B. In addition, in this feed mechanism, the springs 8A, 8B of the lateral biasing mechanism 7 press the displaying transmission wheels 7A, 7B to elastically take up the play between engagement portions and the displaying transmission wheels 7A, 7B and the drive wheel 31 and the play between engagement portions and the displaying transmission wheels 7A, 7B and the displaying follower wheels 6A, 6B. For this reason, even during transmission of the action of the drive wheel 31 to the displaying follower wheels 6A, 6B, the displaying transmission wheels 7A, 7B are positioned in contact with the drive wheel 31 and the displaying follower wheels 6A, 6B, and are positioning the displaying follower wheels 6A, 6B. For this reason, the displaying follower wheels 6A, 6B are not freely moved by disturbance or the like, so that, similar to the first and second embodiments both display jumping can be prevented and a light feeding operation load can be realized in calendar display device 5.

In addition, in the display-correcting rapid feed mechanism 9, if the displaying follower wheels 6A, 6B are rapid-fed without the aid of the drive wheel 31 and the displaying transmission wheels 7A, 7B, the displaying transmission wheels 7A, 7*b* are pushed to the outside from between the drive wheel 31 and the displaying follower wheels 6A, 6B by receiving the force imparted by the rapid feed, so that the engagement of the displaying transmission wheels 7A, 7B with the displaying follower wheel 6A, 6B and with the drive wheel 31 is released. Thus, an effect similar to the first and second embodiments can be obtained at a point where there is no hindrance in manually rapid-feeding the displaying follower wheels 6A, 6*b*.

Fourth Embodiment

Figure 10:
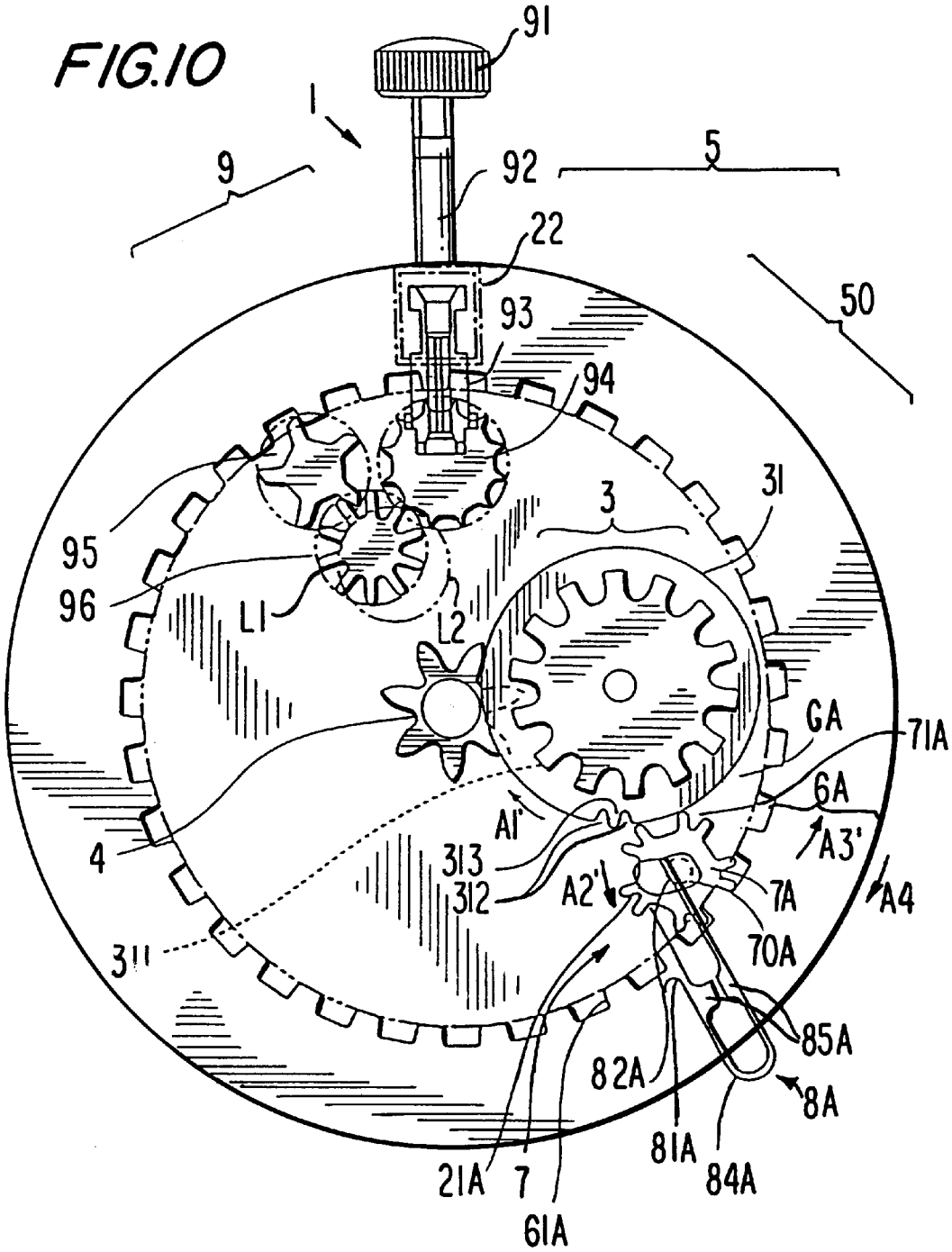
FIG. 10 is a plan view showing the arrangement of respective components constituting a main part of a calendar display device of a wristwatch according to a fourth embodiment of the present invention.

As will be described below, the direction of a force applied to the displaying transmission wheel 7A when performing the calendar feeding may be opposite to the direction (lateral pressure direction) in which the spring 8A presses the displaying transmission wheel 7A. For example, the rotation direction during the normal calendar feeding as shown by the arrows A1', A2' and A3' in FIG. 10 may be set to the opposite direction to that referred to FIG. 1 and FIG. 2. If set in this way, the drive wheel 31 tends to displace the displaying transmission wheel 7A from a gap GA when optionally driving the displaying transmission wheel 7A, so that a load due to a stretch of the teeth generated between the drive wheel 31 and the displaying transmission wheel 7A, and a load due to a stretch of the teeth generated between the displaying transmission wheel 7A and the displaying follower wheel 6A can be reduced. In addition, the direction of the force applied from the drive wheel 31 to the displaying transmission wheel 7A opposes the force of the spring 8A pressing the displaying transmission wheel 7A, so that the rotating central shaft 70A of the displaying transmission wheel 7A can hardly move. Therefore, the rotating central shaft 70A of the displaying transmission wheel 7A can be easily supported. In addition, the rotating central shaft 70A does not abut against the edge of the hole 21A, so that no load is generated between the rotating central shaft 70A and the edge of the hole 21A. Accordingly, a reduction in power consumption when performing the calendar feeding can be achieved.

When constructed in this way, in a sate where an external tooth 313 of the drive wheel 31 is meshed with external teeth 71A of the displaying transmission wheel 7A, a heavy load is applied according to the necessity for rotating the drive wheel 31 in the opposite direction in order to rapid-feed the displaying follower wheel 6A in the direction (the direction shown by the arrow A4) opposite to the calendar-feeding direction through the display-correcting rapid feed mechanism 9. Thus, in a driving force transmission path extending from the drive wheel 31 to the displaying follower wheel 6A via the displaying transmission wheel 6A, a clutch mechanism capable of interrupting the transmission path may be provided so as to rapid-feed the displaying follower wheel with a light load in the opposite direction through the display-correcting rapid feed mechanism 9.

Fifth Embodiment

Figure 11:
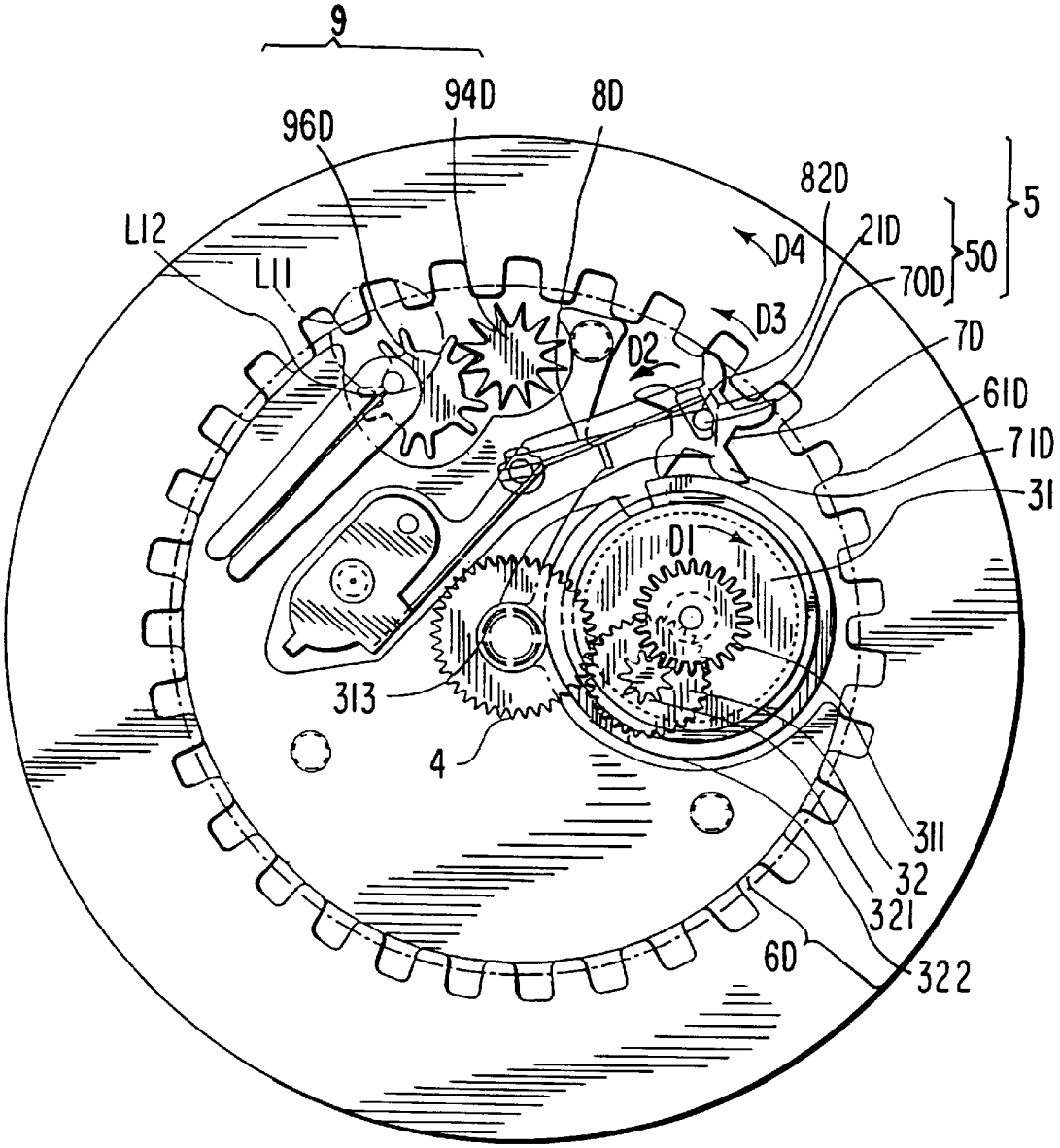
FIG. 11 is a plan view showing the arrangement of respective components constituting a main part of a calendar display device of a wristwatch according to a fifth embodiment of the present invention.
Figure 12:
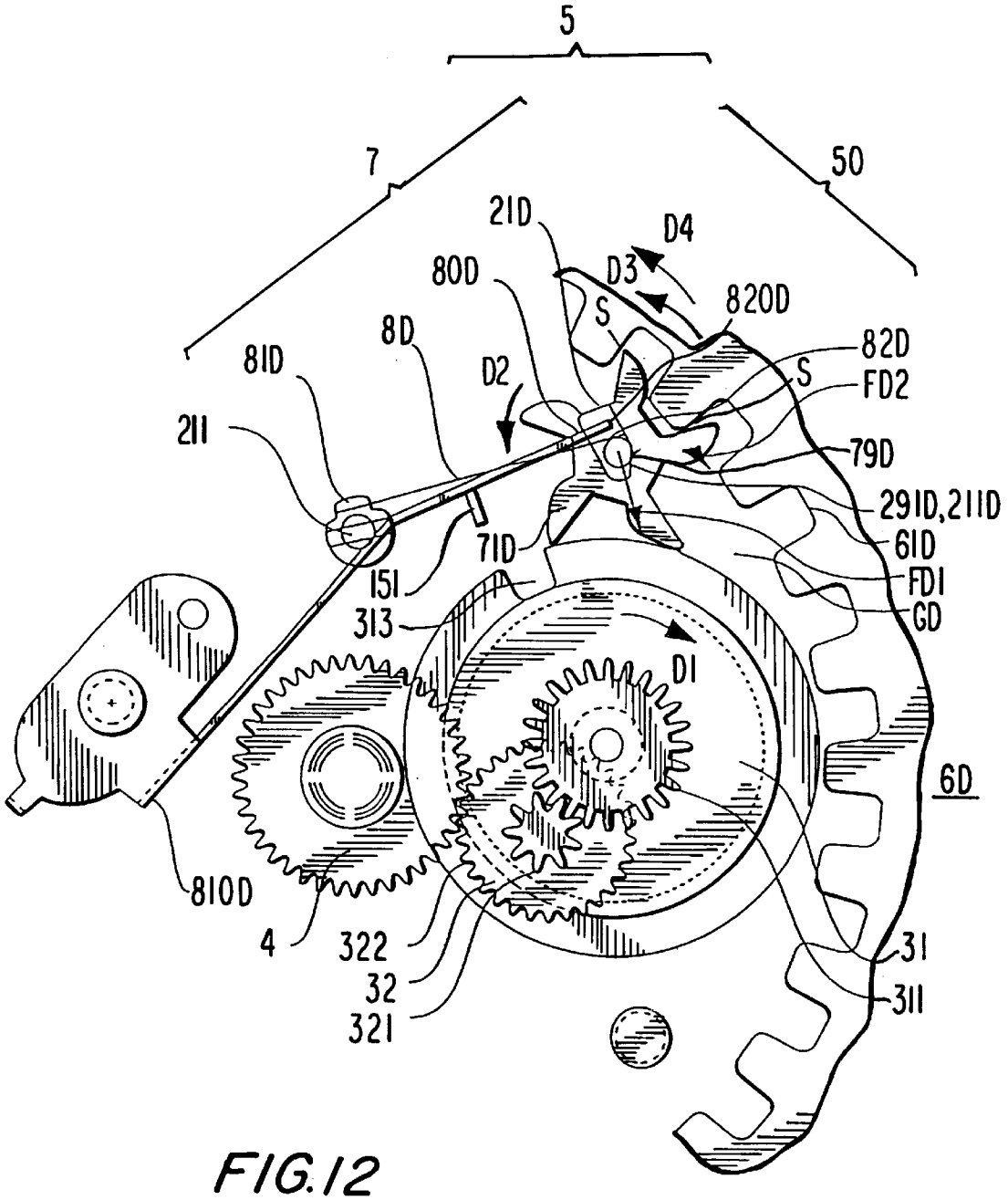
FIG. 12 is an enlarged view of a driving force transmission part in a feed mechanism of the calendar display device shown in FIG. 11.
Figure 14:
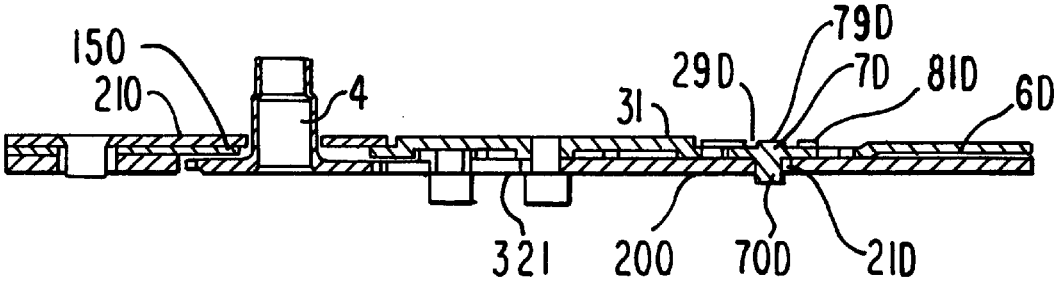
FIG. 14 is a vertical sectional view in which a train wheel around the mesh part of a drive wheel and a displaying transmission wheel is developed to schematically show the engagement states of respective components.
Figure 15:
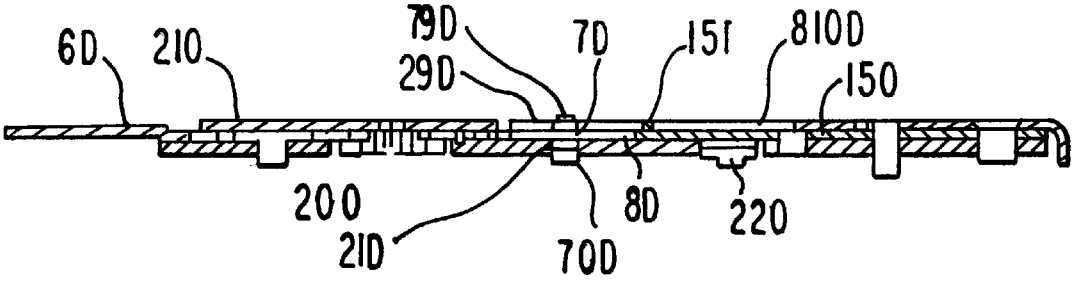
FIG. 15 is a vertical sectional view in which a train wheel of a display-correcting rapid feed mechanism is developed to schematically show the engagement states of respective components.

FIG. 11 is a plan view showing the arrangement of respective components constituting a main part of a calendar display device of a wristwatch according to a fifth embodiment of the present invention, FIG. 12 is an enlarged view of a driving force transmission part in a feed mechanism of the calendar display device, and FIG. 14 and FIG. 15 vertical sectional views, respectively, in which a train wheel constituting the feed mechanism of this calendar display device is developed to schematically show the engagement states of the respective components. Since the basic construction of the calendar display device of this embodiment is similar to that of the first embodiment, components having the corresponding functions are indicated by the same numerals and a detailed description thereof will be omitted. However, of the components having the corresponding functions, the displaying follower wheel 6A, and the spring 8A described in the first embodiment are shown in the drawings and described as a displaying follower wheel 6D, a displaying follower wheel 6B, and springs 8D, 80D.

In FIG. 11 and FIG. 12, in a main body of the wristwatch 1, there is constructed a drive wheel 31 in a drive section 3 comprising a step motor (not shown) to which a rotational driving force is transmitted from the step motor to be rotated once in 24 hours, external teeth 311 formed on the drive wheel 31 for use in time display are meshed with a gear 321 of an intermediate wheel 32 for use in time display, and a gear 322 of this intermediate wheel 32 is meshed with a gear 4 of a sliding pinion for used in time display.

In addition, in the wristwatch 1, there is constructed a calendar display device 5 for switching a date display at a display window 22 (not shown) formed in the direction of 3 o'clock. A feed mechanism 50 of this calendar display device 5 has a Geneva structure comprising a ring-shaped displaying follower wheel 6D (a date indicator of a display section) on which numerals for displaying the date are printed and a displaying transmission wheel 7D which engages both the displaying follower wheel 6D and the drive wheel 31 to transmit the rotation of the drive wheel 31 to the displaying follower wheel 6D, and similar to the time displaying, displays the date making use of a rotation driving force transmitted from the drive wheel.

In this embodiment, since the displaying follower wheel 6D is ring-shaped and has no rotating central shaft, in this embodiment, a guide mechanism (not shown) making use of pins and dowels is constructed to guide follower wheel 6D during positioning.

The drive wheel 31 has a structure such that a gear having external teeth 311 for use in time display formed thereof, and a gear having one recess that is equivalent to an external tooth 313 for use in calendar feeding formed on the outer periphery thereof, are bonded. The displaying follower wheel 6D has thirty-one pieces of internal teeth 61D formed on the inner periphery thereof at intervals of the same angle. The displaying transmission wheel 7D has five depresses and five external teeth 71D formed on the outer periphery thereof at intervals of the same angle.

Figure 13:
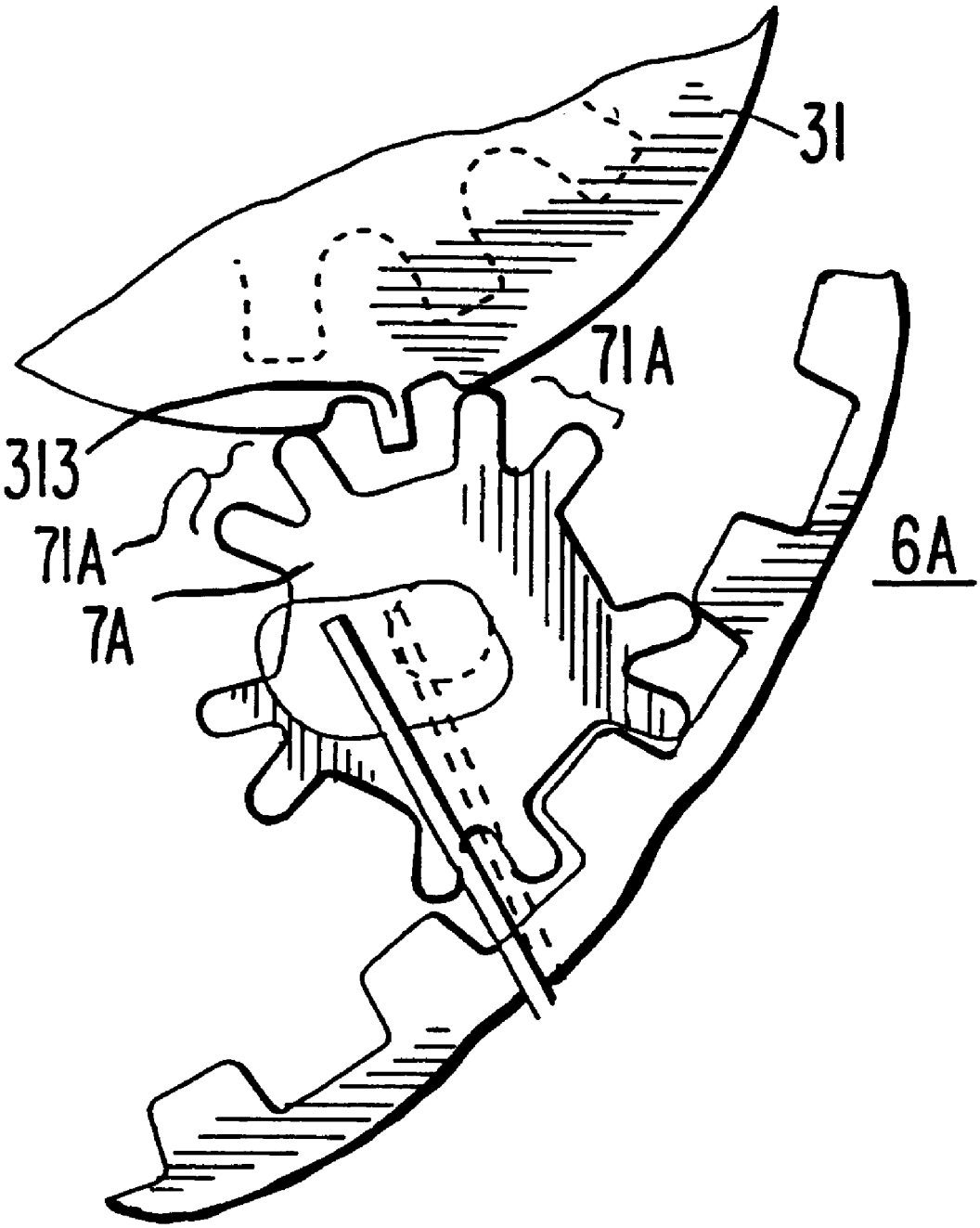
FIG. 13 is an illustration showing a discrepancy which occurs when an external tooth of a split structure is employed.

In this displaying transmission wheel 7D, the reason for constructing the external teeth 71D as one projection is as follows. That is, as shown in FIG. 13, if the tips of the projections (the external teeth 71A) are split at recesses formed therein, a projection which is equivalent to the external tooth 313 of the drive wheel 31 must rise above or mount one of projections constituting the recesses of the displaying transmission wheel 7A in order to enter the recesses of the external teeth 71A to be engaged therewith. For this reason, a load for lifting the displaying transmission wheel 7A against a lateral pressure is applied to the projection which is equivalent to the external tooth 313 of the drive wheel 31. As will be apparent from FIG. 11 and FIG. 12, however, in this embodiment, the displaying transmission wheel 7D has the external teeth 71D consisting of simple projections which are not split at the tips thereof, so that such a load is not generated.

In the thus constructed train wheel, the external teeth 71D of the displaying transmission wheel 7D are meshed with the external tooth 313 of the drive wheel 31, whereby the displaying transmission wheel 7D is externally meshed with the drive wheel 31, and when the drive wheel 31 is rotated in the direction shown by the arrow D1, transmission wheel 7D is rotated in the direction shown by the arrow D2 in association with the rotation. In addition, similarly, the external teeth 71D of the displaying transmission wheel 7D are engaged with the recesses of the internal teeth 61D of the displaying follower wheel 6D, whereby the displaying transmission wheel 7D is internally meshed with the displaying follower wheel 6D, transmits the rotation of the drive wheel 31 to the displaying follower wheel 6D as the rotation in the direction (normal direction) shown by the arrow D3, and switches the display of the date.

In this way, the projections constituting the external teeth 71D on the outer periphery of the displaying transmission wheel 7D are used to both mesh between the outer periphery of the drive wheel 31 and the outer periphery of the displaying transmission wheel 7D, and mesh between the inner periphery of the displaying follower wheel 6D and the outer periphery of the displaying transmission wheel 7D, so that it is not necessary for the displaying transmission wheel 7D to include two two gears bonded one to the other and offset in an axial direction so as to permit one of the gears to engage drive wheel 31 and the other gear to engage displaying follower wheel 6D. For this reason, as shown in FIG. 14 and FIG. 15, the drive wheel 31, the displaying transmission wheel 7D and the displaying follower wheel 6D can be arranged within a gap between a main plate 200 and a pressing plate 210 stacked through a spacer 150. That is, the drive wheel 31, the displaying transmission wheel 7D and the displaying follower wheel 6D can be arranged on the same plane. Accordingly, the feed mechanism 50 of the calendar display device 5 can be reduced in thickness, so that a reduction in thickness of the wristwatch 1 can be achieved.

Returning to FIG. 12, feed mechanism 50 is constructed with a lateral biasing mechanism 7 for elastically biasing the displaying transmission wheel 7D in the direction (shown by the arrow FD1) between the drive wheel 31 and the displaying follower wheel 6D. In this lateral biasing mechanism 7, as shown in FIG. 14 and FIG. 15, rotating central shafts 79D, 70D extending vertically from the gear portions of the displaying transmission wheel 7D are supported in holes 29D, 21D (support means) which are so formed as to overlap the main plate 200 and the pressing plate 210. These holes 29D, 21D, as will be apparent from FIG. 12, extend from the outside of a gap GD formed by the drive wheel 31 and the displaying follower wheel 6D toward the inner part thereof, so that the displaying transmission wheel 7D can move between the outside and the inner part of the gap GD within the formation range of the holes 21D, 29D.

In addition, when viewed from the rotating central shafts 79D, 70D of the displaying transmission wheel 7D, a first spring 8D (elastic member) made of a thin bar of which a base 81D is fixed to a dowel 220 of the pressing plate 210 is arranged outside the gap GD. The first spring 8D is arranged on, near both surfaces of the spacer 150, the side where the main plate 200 is positioned. Further, near both surfaces of the space 150, a second spring 80D (elastic member) is arranged on the side where the pressing plate 210 is positioned. This second spring 80D is formed of a thin bar bent at substantially a center portion in the lengthwise direction, and a base 810D, which is positioned on the opposite side and is fixed to the side of the main plate. In addition, the second spring 80D elastically abuts against a raised portion 151 at a substantially center portion between the bent portion and a tip 820D of the second spring 80D, and in this state, second spring 80D is already elastically deformed to some degree. For this reason, the second spring 80D, as described later, presses the rotating central shaft 79D with a stable spring constant when the rotating central shaft 79D of the displaying transmission wheel 7D abuts against the tip 820D thereof. Here, the second spring 80D is thicker than the first spring 8D and has a larger spring constant.

Of these two springs 8D, 80D, and tip 82D of the first spring 8D, as shown by the arrow FD1, elastically presses the rotating central shaft 70D of the displaying transmission wheel 7D toward the narrow portion of the gap GD. In contrast, the tip 820D of the second spring 80D is, when viewed from the tip 82D of the first spring 8D, positioned outside the gap GD, so that tip 820D neither abuts against the rotating central shaft 79D of the displaying transmission wheel 7D nor acts on the displaying transmission wheel 7D when performing a normal calendar feeding.

Here, since the drive wheel 31 and the displaying follower wheel 6D form the gap GD whose width becomes narrower toward the inner part, the pressing force (lateral pressure) of the first spring 8D pressing the displaying transmission wheel 7D toward the inner part of the gap GD presses the outer periphery of the displaying transmission wheel 7D onto the outer periphery of the drive wheel 31 so as to elastically take up play (clearance) between the drive wheel 31 and the displaying transmission wheel 7D.

Nevertheless, the direction (the direction shown by the arrow FD1) in which the first spring 8D presses the displaying transmission wheel 7D inclines toward the drive wheel 31, and is substantially parallel to the direction of the tangent to the contact position of the displaying transmission wheel 7D and the displaying follower wheel 6D, of the inner peripheral contour circle of the displaying follower wheel 6D (direction shown by the arrow FD2). That is, the direction (shown by the arrow FD1) in which the first spring 8D presses the displaying transmission wheel 7D is the circumferential direction of the inner peripheral contour circle of the displaying follower wheel 6D at the intersection of the inner peripheral contour circle and a line connecting both center points of the displaying follower wheel 6D and the displaying transmission wheel 7D. Therefore, a pressing force of the displaying transmission wheel 7D in the direction of a normal line at the position contacting the drive wheel 31 and the displaying follower wheel 6D is considerably greater at the drive wheel 31 than that at the displaying follower wheel 6D. Therefore, the displaying transmission wheel 7D and the displaying follower wheel 6D are in light contact with each other, and play S is formed between the displaying transmission wheel 7D and the displaying follower wheel 6D. Accordingly, the displaying follower wheel 6D does not become wedge between the drive wheel 31 and the displaying follower wheel 6D during the interval of the calendar feeding, i.e., during a normal operation of hands. Thus, during the normal operation of hands, a spring force of the first spring 8D is merely applied as a load to the drive wheel 31, so that the drive wheel 31 performs a smooth operation of hands.

In addition, in this embodiment, in the inner peripheral contour circle of the displaying follower wheel 6D, in the direction of the normal line at the contact position of the displaying transmission wheel 7D and the displaying follower wheel 6D (the position in the direction perpendicular to the circumferential direction of the inner peripheral contour circle of the displaying follower wheel 6D at the contact position of the displaying transmission wheel 7D and the displaying follower wheel 6D), edges of the holes 29D, 21D become walls 291D, 211D (stoppers) against the displaying transmission wheel 7D. Therefore, the displaying transmission wheel 7D does not advance into the gap GD further, so that it does not become a wedge-like load to the drive wheel 31 during the normal operation of hands. Moreover, since the displaying transmission wheel 7D receives a circumferential lateral pressure with respect to the contour circle of the displaying follower wheel 6D, it is positively pressed against the drive wheel 31 and the walls 291D, 211D (stoppers). Therefore, the displaying transmission wheel 7D is positively positioned by the stoppers without being affected by variations in size of the displaying follower wheel 6D, so that the position of the displaying follower wheel 6D is determined precisely. Accordingly, the slippage of the calendar display is only by the amount corresponding to the looseness of the engagement portions between the displaying transmission wheel 7D and the displaying follower wheel 6D and hence, can be minimized.

Here, since the holes 29D, 21D extend to the outside of the gap GD formed by the drive wheel 31 and the displaying follower wheel 6D when the displaying follower wheel 6D is rotated as shown by the arrow D4 at the time of performing correction of the data display, as described later, the displaying transmission wheel 7D receiving this force from the displaying follower wheel 6D can retract toward the outside from between the drive wheel 31 and the displaying follower wheel 6D.

In FIG. 11 again, in this embodiment, there is constructed a display-correcting rapid feed mechanism 9 for performing the correction of the data display by rotating the displaying follower wheel 6D in rapid-feeding without the aid of the drive wheel 31 and the displaying transmission wheel 7D. This display-correcting rapid feed mechanism 9 basically performs the same function as the mechanism described with reference to FIG. 1. That is, there are constructed a winding stem (not shown)having a crown (not shown) fixed to the outer end portion thereof, a sliding pinion fixed to the winding stem, a first display-correcting transmission wheel 94D to which the rotation of the sliding pinion is transmitted, and a second display-correcting transmission wheel 96D which shifts to a position where it is meshed with the displaying follower wheel 6D when the crown is pulled out and the crown in rotated in the correction direction for the data display. Therefore, if the crown is pulled out and the crown in rotated in the correction direction for the data display, the second display-correcting transmission wheel 96 shifts from the position shown by the solid line L12 to the position shown by the one-dot chain line L11 to mesh with the displaying follower wheel 6D, so that the rotational action of the crown in transmitted to the displaying follower wheel 6D as the rotation in the direction of the arrow D4 through the first display-correcting transmission wheel 94 and the second display-correcting transmission wheel 96. Therefore, it is possible to rapid-feed manually the displaying follower wheel 6D. However, when the crown is pressed, the sliding pinion shifts from the engagement position with the fist display-correcting transmission wheel 94 and the engagement thereof released, so that an excessive load is not applied to the drive wheel 31 and the displaying transmission wheel 7D when the displaying follower wheel 6D is allowed to perform a normal calendar-feeding operation through the drive wheel 31 and the displaying transmission wheel 7D.

In the thus constructed calendar display device 5, if the rotational driving force from the aforementioned step motor is transmitted to allow the drive wheel 31 to rotate once in 24 hours as shown by the arrow D1, and the external teeth 71D of the displaying transmission wheel 7D. As a result, the displaying transmission wheel 7D stops after rotating by an angle of 72° (by one step) in 24 hours in the direction shown by the arrow D2. During this period, the displaying transmission wheel 7D rotates the displaying follower wheel 6D, which is internally meshed therewith through the external teeth 71D and the internal teeth 61D, about by 11.6° (by one step) in 24 hours to advance the display performed at the display window 22 and then stops.

When such a normal calendar feeding is performed once in 24 hours, since the feed mechanism 50 of the calendar display device 5 has the Geneva structure, the displaying transmission wheel 7D rotates smoothly if meshed with the drive wheel 31 during the calendar feeding, and the driving force can be efficiently transmitted.

In addition, the displaying transmission wheel 7D is strongly pressed by the first spring 8D toward the drive wheel 31. For this reason, the displaying transmission wheel 7D merely contacts lightly the displaying follower wheel 6D, so that the mesh between the displaying transmission wheel 7D and the displaying follower wheel 6D is slight. Therefore, a load due to the stretch of the teeth can be reduced between the displaying transmission wheel 7D and the displaying follower wheel 6D. Accordingly, no excessive load is generated between the displaying transmission wheel 7D and the drive wheel 31 and the between the displaying transmission wheel 7D and the displaying follower wheel 6D, so that a reduction in power consumption of the wristwatch 1 (calendar display mechanism 5) can be achieved.

Here, although the holes 29D, 21D extend to the inside of the gap GD, during the interval of the normal calendar feeding, the rotating central shaft 70D of the displaying transmission wheel 7D is located at the position ear the center of the holes 29D, 21D and is not in contact with the inner edges of the holes 29D, 21D (see FIG. 12). However, the direction of the force applied from the drive wheel 31 to the displaying transmission wheel 7D when performing the calendar feeding is the same as the direction in which the first spring 8D presses the displaying transmission wheel 7D (the direction of lateral pressure), and is the direction in which the displaying transmission wheel 7D is moved more deeply into the gap GD. For this reason, when the drive wheel 31 rotationally drives the displaying transmission wheel 7D may excessively enter into the inner part of the gap GD. In this embodiment, however, since the rotating central shaft 70D of the displaying transmission wheel 7D strikes the walls 291D, 211D of the holes 29D, 21D, it will not advance further between the drive wheel 31 and the displaying follower wheel 6D. Therefore, the load generated between the drive wheel 31 and the displaying follower wheel 6D due to the stretch of the teeth, and the load generated between the displaying transmission wheel 7D and the displaying follower wheel 6D due to the stretch of the teeth can be reduced. Accordingly, a reduction in power consumption at the time of performing the calendar display can be achieved.

In addition, the holes 29D, 21D have wide widths when viewed from the diameters of the rotating central shafts 79D, 70D, so that the displaying transmission wheel 7D can move either toward the drive wheel or toward the displaying follower wheel 6D (the direction perpendicular to the direction of the lateral pressure). For this reason, the displaying transmission wheel 7D shifts to the most suitable position by balancing the force received from the drive wheel 31 and the force received from the displaying follower wheel 6D. As a result, the displaying transmission wheel 7D can positively fill up the looseness between the displaying transmission wheel 7D and the drive wheel 31, and between the displaying transmission wheel 7D and the displaying follower wheel 6D with a proper force, so that the rattle peculiar to the Geneva structure can be prevented.

Further, even in the interval of the calendar feeding, the displaying transmission wheel 7D is strongly pressed by the first spring 8D toward the drive wheel 31. For this reason, the displaying transmission wheel 7D lightly contacts the displaying follower wheel 6D, but strongly contacts the drive wheel 31. Therefore, the displaying follower wheel 6D is not freely moved by disturbance or the like, so that the display jumping can be prevented. Thus, the calendar display device 5 may be constructed with a light feeding operation load, while preventing display jumping.

In addition, in this embodiment, the first spring 8D is abutted against the rotating central shaft 70D in applying a lateral pressure to the displaying transmission wheel 7D, so that it is easy to set the direction and the magnitude of the force for pressing the displaying transmission wheel 7D to the most suitable conditions, while utilizing a displaying follower wheel 6D without shifting position to prevent display jumping. Moreover, the tip 82D of the first spring 8D is in contact with the rotating central shaft 70D, and the diameter of the rotating central shaft 70D is small. Therefore, a frictional load torque can be lowered owing to low friction at the contact portion of the first spring 8D and the rotating central shaft 70D when the drive wheel 31 rotates the displaying transmission wheel 7D, so that this is suitable for a reduction in power consumption.

Further, if the crown is pulled out and rotated in the correction direction for the date display when the date display is intended to be corrected in the calendar display device 5 in this embodiment, the displaying follower wheel 6D is rapid-fed in the direction shown by the arrow D4 without the aid of the drive wheel 31 and the displaying transmission wheel 7D. At this time, if the position of the displaying transmission wheel 7D is completely fixed, a heavy load is applied from the driving transmission wheel 7D and the drive wheel 31 when rotating the displaying follower wheel 6D. In this embodiment, however, the displaying transmission wheel 7D is movable within the formation range of the hole 29D, 21D, and the displaying transmission wheel 7D is merely engaged with the displaying follower wheel 6D by the pressing forcing of the first spring 8D. Accordingly, when rapid-feeding the displaying follower wheel 6D through the crown, by receiving the force thereof, the displaying transmission wheel 7D is displaced from the inner part of the gap GD to the outside, so that the engagement between the displaying transmission wheel 7D and the displaying follower wheel 6D is released. Thus, manually rapid-feeding the displaying follower wheel 6D is smooth. In addition, when returning to the state of the normal calendar feeding from this state, the displaying transmission wheel 7D can shift in either direction toward the drive wheel 31 or toward the displaying follower wheel 6D (the direction perpendicular to the direction of the lateral pressure) in the holes 29D, 21D, so that the displaying transmission wheel 7D smoothly returns to the state of re-engagement with the drive wheel 31 and the displaying follower wheel 6D.

In addition, in this embodiment, as will be apparent from FIG. 12, in the lateral biasing mechanism 7, of the first spring 8D and the second spring 80D, the first spring 8D is constructed so as to keep imparting a bias toward the area between the drive wheel 31 and the displaying follower wheel 7D to the displaying transmission wheel 7D, and the second spring 80D is constructed so as to start imparting a bias toward the area between the drive wheel 31 and the displaying follower wheel 6D to the displaying transmission wheel 7D from midway of movement of the displaying transmission wheel 7D in the direction opposite to the direction to enter between the drive wheel 31 and the displaying follower wheel 6D. For this reason, when display jumping occurs on the displaying follower wheel 6D, the displaying transmission wheel 7D is greatly displaced, but in such a case, both the first spring 8D and the second spring 80D act on the displaying transmission wheel 7D, so that the spring constant is large. Accordingly, since the displaying transmission wheel 7D is not greatly displaced, the display jumping does not occur. In contrast, at the time of the normal display-feeding operation, only the first spring 8D acts on the displaying transmission wheel 7D, so that the spring constant is small. Therefore, the load between the displaying transmission wheel 7D and the drive wheel 3, and the load between the displaying transmission wheel 7D and the displaying follower wheel 6D may become light. Accordingly, display jumping can be positively prevented, while achieving a reduction in power consumption during the calendar-feeding operation. In addition, since the second spring 80D has a spring constant larger than that of the first spring 8D, when the displaying transmission wheel 7D is to be greatly displaced, a large force is required to push back displaying transmission wheel 7D, so that display jumping can be prevented more positively.

Figure 16:
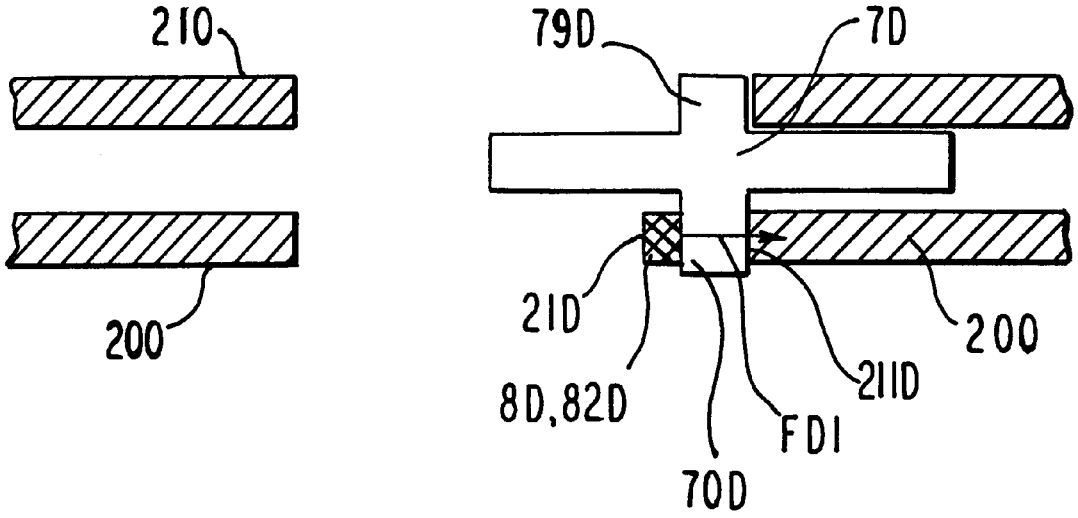
FIG. 16 is an illustration showing a state where a lateral pressure is imparted to a central axis of rotation of a displaying transmission wheel in the calendar display device shown in FIG. 11.
Figure 17:
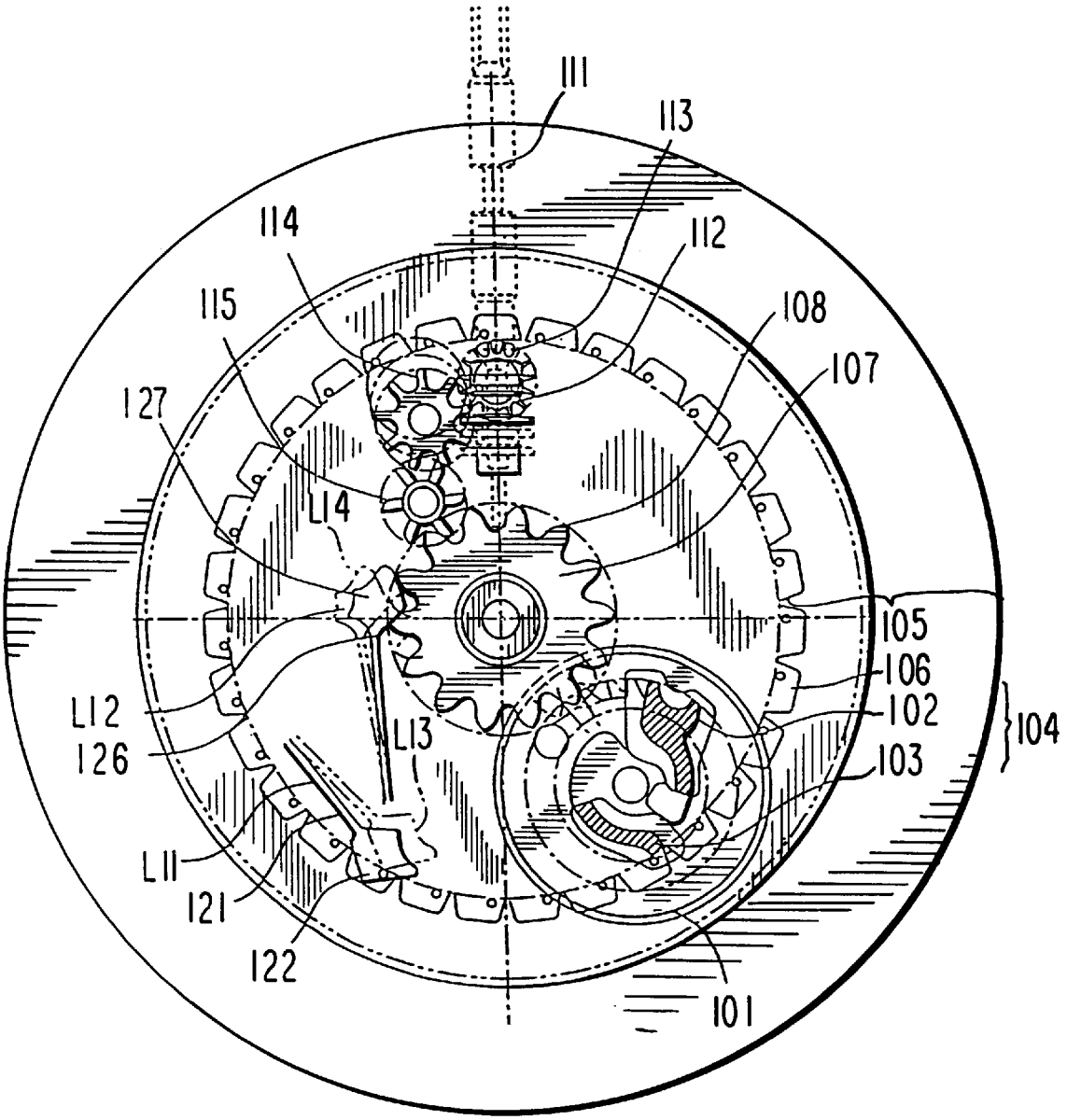
FIG.17 PRIOR ART
FIG. 17 is a plan view showing the arrangement of respective components constituting a main part of a conventional calendar display device of the prior art.

Further, also in this embodiment, as shown in FIG. 16, in the lateral biasing mechanism 7, the tip 82D of the first spring 8D abuts against the rotating central shaft 70D of the displaying transmission wheel 7D at the position opposing the edge (the wall 211D/stopper) of the hole 21D formed in the main plate 200 so as to impart a bias toward the wall 211D to the displaying transmission wheel 7D. For this reason, even if the rotating central shaft 70D of the displaying transmission wheel 7D is pressed by the tip 82 of the spring 8D to strike the wall 211D, the rotating central shaft 70D of the displaying transmission wheel 7D does not tilt. Accordingly, the load applied when the drive wheel 31 rotates the displaying transmission wheel 7D, or the load applied when the displaying transmission wheel 7D rotates the displaying follower wheel 6D can be reduced.

Incidentally, in all the above-described embodiments, although the displaying transmission wheels 7A, 7B, 7D are pressed by the spring 8A, 8B, 8D, 80D formed of the substantially U-shaped thin plate or a thin bar, these springs, a plate spring, a coil spring, a hair spring and so forth can be employed. In addition, an elastic body such as a rubber band may be employed without being limited to the spring if it can elastically press the displaying transmission wheels 7A, 7B, 7D.

In addition, without being limited to the way in which a bias is imparted to the displaying transmission wheels 7A, 7B, 7D by members separated from those of the displaying transmission wheels 7A, 7B, 7D, the displaying transmission wheels 7A, 7B, 7D may be formed of rubber, and bias the displaying transmission wheels 7A, 7B, 7D to advance between the drive wheel 31 and the displaying follower wheels 6A, 6B, 6D by their own elastic deforming force. When constructed in this way, the feed mechanism 50 of the Geneva structure can be constructed in which the looseness between the drive wheel 31 and the displaying transmission wheel 7A, 7B, 7D is elastically taken up by the elastic force of the displaying transmission wheel 7A, 7B, 7D. In addition, in this feed mechanism 50 of the Geneva structure, the displaying follower wheels 6A, 6B, 6D can be positioned by the displaying transmission wheel 7A, 7B, 7D, and when rapid-feeding the displaying follower wheels 6A, 6B, 6D, the engagement with the displaying follower wheels 6A, 6B, 6D is released by the elastic deformation of the displaying transmission wheel 7A, 7B, 7D. Here, in order to construct the displaying transmission wheel 7A, 7B, 7D as elastically deformable components, without being limited to a case where they are formed of rubber, voids and the like may be partially provided so that the displaying transmission wheel 7A, 7B, 7D elastically deform making use of the fact that they are depressed toward the voids.

In addition, in the above first, second and fifth embodiments, although the springs 8A, 8B, 8D are constructed so as to press through the rotating central shafts 70A, 70B, 70D of the displaying transmission wheel 7A, 7B, elastic members such as the springs 8A, 8B, 8D may be constructed so as to press the outer periphery of the displaying transmission wheel 7A, 7B, 7D (the outer edge of the external teeth). When constructed in this way, the springs 8A, 8B, 8D and the displaying transmission wheel 7A, 7B, 7D can be arranged on the same plane, so that a reduction in thickness of the calendar display device 5, i.e., a reduction in thickness of the wristwatch 1, can be achieved.

In addition, between the members for transmitting the driving force to each other, wear or the like may be prevented by using different materials therefor. For example, regarding the drive wheel 31 and the displaying transmission wheel 7A, 7B, 7D, one may be made of plastic and the other may be made of metal.

Further, regarding the drive wheel 31 and the displaying transmission wheel 7A, 7B, 7D, they may be subjected to a lubricating process, such as flourine resin process so as to lower the friction load torque. When constructed in this way, the necessity for using lubricating oil is eliminated, so that a ringing load can be lightened. In addition, at a display portion, a stain or the like due to the adhesion of the oil to a printing surface is prevented.

Incidentally, in the above-described embodiments, although an example of displaying a date and a day in the wristwatch 1 is described, a calendar display device may be constructed in which the present invention is applied to a wristwatch, a clock or the like. Further, matters to be displayed are not limited to a date and a day, and a time, a month, a year, the age of the moon, the position of the sun and further, results of measurement of the depth of water, barometric pressure, temperature, humidity, direction, velocity and so forth may be displayed.

Industrial Applicability

As described above, the display device according to the present invention is characterized by the lateral biasing means for elastically biasing the displaying transmission wheel between the drive wheel and the displaying follower wheel. Therefore, according to the present invention, in the feed mechanism of the Geneva structure, even without using the jumper spring, the lateral biasing means presses the displaying transmission wheel to elastically take up the play of the engagement portions between the displaying transmission wheel and the drive wheel, or the play of the engagement portions between the displaying transmission wheel and the displaying follower wheel. For this reason, during the interval of the feed-driving, the displaying transmission wheel is positioned in contact with the drive wheel and the displaying follower wheel, and positions the displaying follower wheel in this state. For this reason, the displaying follower wheel is not freely moved by disturbance or the like, so that the display jumping can be prevented. In addition, since the lateral biasing means elastically takes up the play, the load of the feeding operation is reduced. Accordingly, the display device in which a load of the feeding operation is light and display jumping does not occur can be realized.

In the present invention, even when the display-correcting rapid feed mechanism, which performs the correction of display by feed-driving the display follower wheel without the aid of the drive wheel and the displaying transmission wheel is provided, since the displaying transmission wheel merely positions the displaying follower wheel with elasticity, a force applied to the displaying transmission wheel when the displaying follower wheel is moved without the aid of the drive wheel and the displaying transmission wheel is absorbed by the elasticity, so that the displaying follower wheel can be smoothly rapid-fed in the opposite direction.

What is claimed is:

1. A display device including a Geneva feed mechanism for a calendar display device, the display device, comprising:

a drive wheel;

a displaying follower wheel;

a displaying transmission wheel engaging both said displaying follower wheel and said drive wheel to transmit an action of said drive wheel to said displaying follower wheel;

a biasing means for imparting a bias in a direction to move toward said displaying transmission wheel between said drive wheel and said displaying follower wheel.

2. The display device according to claim 1, wherein said biasing means takes up play between said displaying transmission wheel and said drive wheel and play between said displaying transmission wheel and said displaying follower wheel by biasing said displaying transmission wheel.

3. The display device according to claim 1, wherein said biasing means takes up play between said displaying transmission wheel and said displaying follower wheel by imparting a biasing force, in the direction inclined toward said displaying follower wheel, between said drive wheel and said displaying follower wheel to said displaying transmission wheel.

4. The display device according to claim 3, wherein said drive wheel forms a circle having a contour and said biasing means is constructed so as to impart a biasing force in a circumferential direction of the contour circle of said drive wheel at the intersection of said contour circle and a line connecting both center points of rotation of said drive wheel and said displaying transmission wheel to said displaying transmission wheel.

5. The display device according to claim 1, wherein the lateral pressure-imparting biasing means takes up play between said displaying transmission wheel and said drive wheel by biasing said drive wheel in the direction inclined toward said drive wheel between said drive wheel and said displaying follower wheel to said displaying transmission wheel.

6. The display device according to claim 5, wherein said outer periphery of said displaying follower wheel forms a circle and said biasing means is constructed so as to bias said displaying transmission wheel in a circumferential direction of said circle of said displaying follower wheel at the intersection of said circle and a line connecting both center points of rotation of said displaying follower wheel and said displaying transmission wheel.

7. The display device according to claim 1, further including a stopper for preventing said displaying transmission wheel from excessively advancing between said drive wheel and said displaying follower wheel at the position on the side of the direction of the application of the biasing force with respect to said displaying transmission wheel.

8. The display device according to claim 1, wherein said displaying transmission wheel includes a rotating central shaft and said biasing means abuts against said rotating central shaft of said displaying transmission wheel at a potions opposing said stopper so as to bias said stopper to said displaying transmission wheel.

9. The display device according to claim 1, further including a display-correcting mechanism for correcting a display by driving said displaying follower wheel through a transmission assembly that does not include said drive wheel and said displaying transmission wheel.

10. The display device according to claim 9, wherein said display-correcting mechanism, during the correction of display, drives said displaying follower wheel in the same direction as the direction said drive wheel and said displaying transmission wheel drive said displaying follower wheel.

11. The display device according to claim 9, wherein said display-correcting mechanism, during the correction of display, drives said displaying follower wheel in the direction opposite to the direction said drive wheel and said displaying transmission wheel drive said displaying follower wheel.

12. The display device according to claim 1, wherein said drive wheel, said displaying transmission wheel and said displaying follower wheel are arranged on substantially the same plane.

13. The display device according to claim 12, wherein said displaying transmission wheel comprises transmission projections formed on this outer periphery having transmission recesses, said displayed follower wheel having follower recesses, and said drive wheel comprises a drive wheel projection formed on this periphery, said transmission projections engaging said follower recesses and said drive wheel projection engaging one of said transmission recesses projections engaging said recesses.

14. The display device according to claim 12, wherein said displaying transmission wheel comprises projections formed on this outer periphery, said displaying follower wheel having a first recess formed on the periphery thereof, and said drive wheel having a second recess formed on the periphery thereof, said projections engaging said first and second recesses.

15. The display device according to claim 1, wherein said displaying transmission wheel comprises external teeth, and said displaying follower wheel comprises internal teeth, and wherein said displaying transmission wheel is constructed so as to be internally engaged with said displaying follower wheel.

16. The display device according to claim 15, comprising a guide mechanism for guiding said displaying follower wheel, and wherein said displaying follower wheel informed in the shape of a ring having internal teeth.

17. The display device according to claim 1, wherein both of said displaying transmission wheel and said displaying follower wheel comprise external teeth, and wherein said displaying transmission wheel is constructed so as to be externally engaged with said displaying follower wheel.

18. The display device according to claim 1, wherein said biasing means comprises support means for supporting said displaying transmission wheel in a movable state between a direction to enter between said drive wheel and said displaying follower wheel and an opposite direction thereof, said displaying transmission wheel includes a rotating central shaft, and an elastic member for biasing said displaying transmission wheel through the rotating central shaft of said displaying transmission wheel.

19. The display device according to any claim 1, wherein said biasing means comprises support means for supporting said displaying transmission wheel in a movable state between a direction to enter between said drive wheel and said displaying follower wheel and an opposite direction thereof, and an elastic member for biasing said displaying transmission wheel through the outer periphery of said displaying transmission wheel.

20. The display device according to claim 18, wherein said displaying transmission wheel is supported by said support means in a movable state between a direction toward said drive wheel and toward said displaying follower wheel.

21. The display device according to claim 18, wherein said elastic member is constructed so that a spring constant is switched from a small value to a large value from midway of movement of said displaying transmission wheel in the direction opposite to the direction to enter between said drive wheel and said displaying follower wheel against a pressing force of said elastic member.

22. The display device according to claim 21, wherein said elastic member consists of one spring comprising a first deformation portion which continuously biases the transmission wheel in the direction to enter between said drive wheel and said displaying follower wheel, and a second deformation portion which starts biasing said displaying transmission wheel in the direction to enter between said drive wheel and said displaying follower wheel from midway of movement of said displaying transmission wheel in the direction opposite to the direction to enter between said drive wheel and said displaying follower wheel.

23. The display device according to claim 22, wherein said second deformation portion has a spring constant larger than that of said first deformation portion.

24. The display device according to claim 21, wherein said elastic member consists of a first spring which continuously biases the transmission wheel in the direction to enter between said drive wheel and said displaying follower wheel, and a second spring which starts biasing said displaying transmission wheel in the direction to enter between said drive wheel and said displaying follower wheel from midway of movement of said displaying transmission wheel in the direction opposite to the direction to enter between said drive wheel and said displaying follower wheel.

25. The display device according to claim 24, wherein said second spring has a spring constant larger than that of said first spring.

26. The display device according to claim 18, wherein said elastic member is arranged so that at least a part thereof overlap said displaying follower wheel in plan view.

27. The display device according to claim 18, wherein said elastic member is arranged so as not to overlap said displaying follower wheel in plan view.

28. The display device according to claim 1, wherein said drive wheel rotationally drives said displaying transmission wheel so that an action force in the same direction as the direction of the application of said bias is generated on said displaying transmission wheel, and wherein a stopper for preventing said displaying transmission wheel from excessively advancing between said drive wheel and said displaying follower wheel at the position on the side of the direction of the application of said bias with respect to said displaying transmission wheel.

29. The display device according to claim 1, wherein said drive wheel rotationally drives said displaying transmission wheel so that an action force in the direction opposite to the direction of the application of said bias is generated on said displaying transmission wheel.

30. The display device according to claim 29, further including a driving force transmission path extending from said drive wheel to said displaying follower wheel via said displaying transmission wheel and a clutch mechanism for selectively disconnecting said transmission path.

31. The display device according to claim 1, wherein said biasing means utilizing the elastic deformation of said displaying transmission wheel.

32. The display device according to claim 1, wherein said drive wheel is formed from a different material than said displaying transmission wheel.

33. The display device according to claim 1, wherein a process for increasing lubricity is applied to at least one of said drive wheel and said displaying transmission wheel.

34. The display device according to claim 1, wherein said display device is a watch.

* * * * *